US012710176B1

(12) United States Patent
Ganiger et al.

(10) Patent No.: US 12,710,176 B1
(45) Date of Patent: Aug. 18, 2026

(54) COMBUSTOR ASSEMBLY FOR A GAS TURBINE ENGINE

(71) Applicant: General Electric Company, Evendale, OH (US)

(72) Inventors: Ravindra Shankar Ganiger, Bangalore (IN); Steven Clayton Vise, Loveland, OH (US); Michael Anthony Benjamin, Cincinnati, OH (US); Sibtosh Pal, Mason, OH (US); Hiranya Kumar Nath, Bangalore (IN); Daniel D. Brown, Cincinnati, OH (US); Eyitayo James Owoeye, Houston, TX (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 19/299,986

(22) Filed: Aug. 14, 2025

(51) Int. Cl.
*F23R 3/60* (2006.01)
*F23R 3/00* (2006.01)

(52) U.S. Cl.
CPC ..... *F23R 3/60* (2013.01); *F23R 3/007* (2013.01)

(58) Field of Classification Search
CPC .... F23R 3/007; F23R 3/60; F23R 3/50; F23R 3/002; F23R 3/00; F23R 2900/00017; F23R 2900/00012; F23M 2900/05002; F23M 5/00
See application file for complete search history.

(56) References Cited

U.S. PATENT DOCUMENTS

| | | | | |
|---|---|---|---|---|
| 3,138,930 | A * | 6/1964 | Everett | F23R 3/08 60/757 |
| 4,747,543 | A | 5/1988 | Madden | |
| 5,059,055 | A * | 10/1991 | DeGress | F16B 3/00 403/364 |
| 5,079,915 | A | 1/1992 | Veau | |
| 5,921,075 | A | 7/1999 | Shimoyama et al. | |
| 6,779,268 | B1 | 8/2004 | Farmer | |
| 7,581,399 | B2 * | 9/2009 | Farah | F02K 1/822 411/521 |
| 7,631,481 | B2 * | 12/2009 | Cowan | F02K 1/827 60/770 |
| 7,762,076 | B2 | 7/2010 | Shi et al. | |

(Continued)

FOREIGN PATENT DOCUMENTS

| | | | | |
|---|---|---|---|---|
| EP | 2952813 | A1 * | 12/2015 | F23R 3/50 |
| JP | 2025133698 | A * | 9/2025 | F01D 25/30 |

(Continued)

*Primary Examiner* — Craig Kim
(74) *Attorney, Agent, or Firm* — Dority & Manning, P.A.

(57) ABSTRACT

A combustor assembly for a gas turbine engine that defines an axial direction includes a combustor liner support assembly. A plurality of liner tiles are coupled to the combustor liner support assembly and define at least part of a combustion chamber that extends between a forward end and an aft end generally along the axial direction with respect to the combustor liner support assembly. A first liner tile of the plurality of liner tiles defines one or more first knuckles, and a second liner tile of the plurality of liner tiles defines one or more second knuckles. The one or more first knuckles are hingably coupled to the one or more second knuckles to mechanically interlock the first liner tile to the second liner tile.

20 Claims, 16 Drawing Sheets

(56) References Cited

U.S. PATENT DOCUMENTS

| | | | | |
|---|---|---|---|---|
| 8,727,714 | B2 * | 5/2014 | Snider | F23R 3/002 415/178 |
| 9,309,834 | B2 * | 4/2016 | Peters | F02K 1/822 |
| 9,322,335 | B2 | 4/2016 | Charron et al. | |
| 9,382,875 | B2 * | 7/2016 | Kramer | F02C 7/20 |
| 9,404,390 | B2 | 8/2016 | Griese et al. | |
| 9,423,129 | B2 * | 8/2016 | Graves | F23R 3/002 |
| 9,476,524 | B2 * | 10/2016 | Parrish | F16L 3/12 |
| 9,651,258 | B2 * | 5/2017 | Graves | F23R 3/002 |
| 10,473,331 | B2 * | 11/2019 | Quach | F23R 3/002 |
| 10,502,421 | B2 * | 12/2019 | Harding | F02C 7/20 |
| 10,577,977 | B2 | 3/2020 | Baucco | |
| 10,578,021 | B2 | 3/2020 | Prociw | |
| 10,648,666 | B2 | 5/2020 | Bouldin et al. | |
| 10,801,731 | B2 * | 10/2020 | Dillard | F23R 3/60 |
| 10,907,830 | B2 * | 2/2021 | Wilson | F23R 3/005 |
| 11,009,232 | B2 | 5/2021 | Imfeld et al. | |
| 11,226,099 | B2 * | 1/2022 | Freeman | F23R 3/60 |
| 11,306,660 | B2 | 4/2022 | Morenko | |
| 11,359,505 | B2 * | 6/2022 | Read | F01D 25/246 |
| 11,859,823 | B2 * | 1/2024 | Ganiger | F23R 3/60 |
| 11,859,824 | B2 * | 1/2024 | Ganiger | F23R 3/06 |
| 11,867,398 | B2 * | 1/2024 | Ganiger | F23M 5/04 |
| 12,066,187 | B2 * | 8/2024 | Ganiger | F23R 3/60 |
| 2014/0360196 | A1 * | 12/2014 | Graves | F23R 3/002 60/753 |
| 2019/0113236 | A1 * | 4/2019 | Jin | F01D 9/023 |
| 2021/0108798 | A1 * | 4/2021 | Freeman | F23R 3/50 |
| 2021/0325043 | A1 * | 10/2021 | Freeman | F23R 3/46 |

FOREIGN PATENT DOCUMENTS

| | | | |
|---|---|---|---|
| WO | WO2016/076852 | A1 | 5/2016 |
| WO | WO2017/116243 | A1 | 7/2017 |

* cited by examiner

COMBUSTOR ASSEMBLY FOR A GAS TURBINE ENGINE

FIELD

The present subject matter relates generally to a gas turbine engine, or more particularly to a combustor assembly for a gas turbine engine.

BACKGROUND

A gas turbine engine generally includes a fan and a core arranged in flow communication with one another. In addition, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gasses through the turbine section drives the turbine section and is then routed through the exhaust section, e.g., to the atmosphere.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

Figure 1:
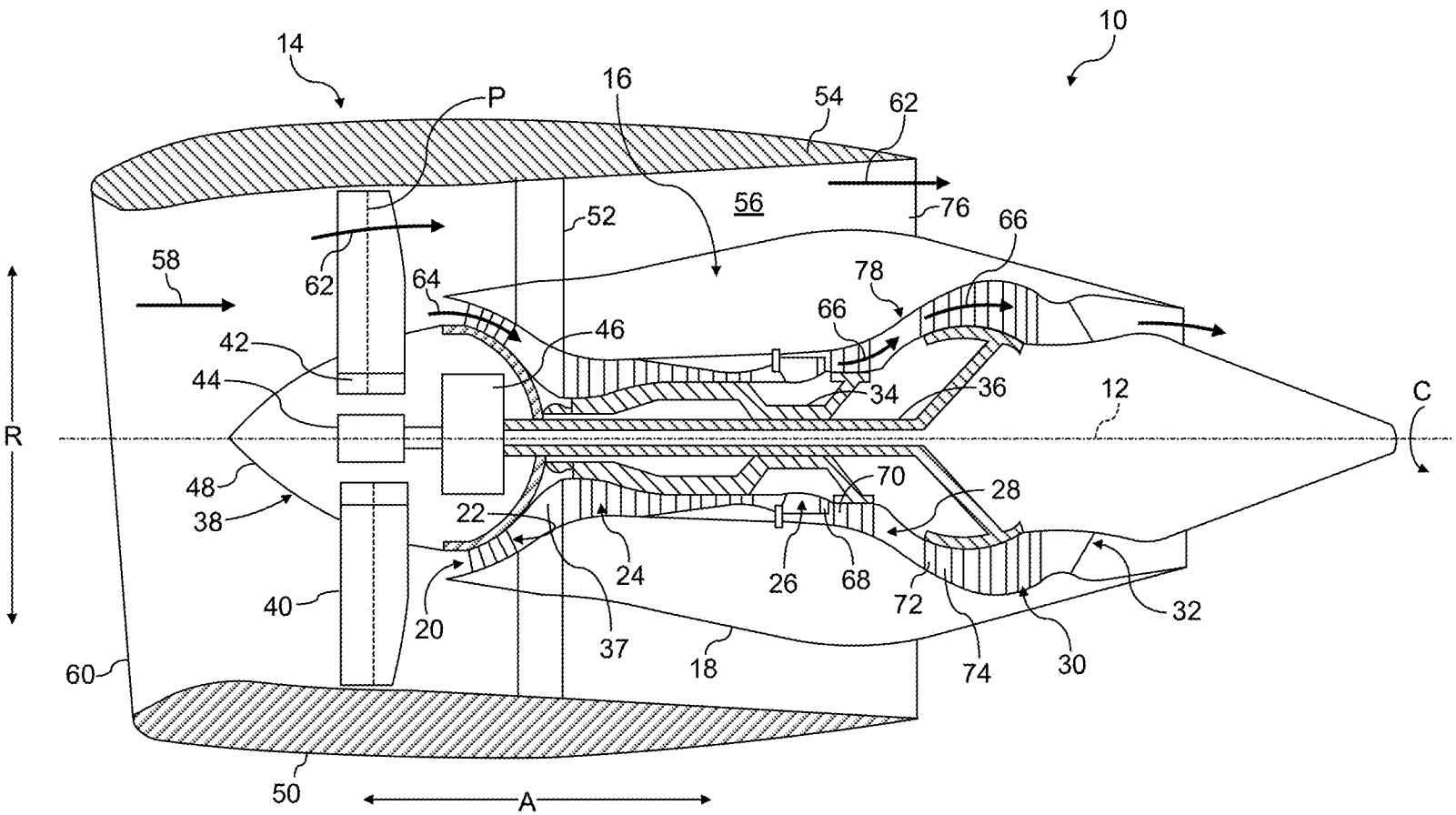
FIG. 1 provides a schematic view of an exemplary gas turbine engine in accordance with one or more embodiments of the present disclosure.

Repeat use of reference characters in the present specification and drawings is intended to represent the same or analogous features or elements of the present disclosure.

DETAILED DESCRIPTION

Reference now will be made in detail to embodiments of the present disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the present disclosure. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The singular forms "a", "an", and "the" include plural references unless the context clearly dictates otherwise.

The term "at least one of" in the context of, e.g., "at least one of A, B, or C" refers to only A, only B, only C, or any combination of A, B, and C.

The terms "coupled," "fixed," "attached to," and the like refer to both direct coupling, fixing, or attaching, as well as indirect coupling, fixing, or attaching through one or more intermediate components or features, unless otherwise specified herein.

As used herein, the terms "first," "second," and "third" may be used interchangeably to distinguish one component from another and are not intended to signify location or importance of the individual components.

For purposes of the description hereinafter, the terms "upper", "lower", "right", "left", "vertical", "horizontal", "top", "bottom", "lateral", "longitudinal", and derivatives thereof shall relate to the embodiments as they are oriented in the drawing figures. However, it is to be understood that the embodiments may assume various alternative variations, except where expressly specified to the contrary. It is also to be understood that the specific devices illustrated in the attached drawings, and described in the following specification, are simply exemplary embodiments of the disclosure. Hence, specific dimensions and other physical characteristics related to the embodiments disclosed herein are not to be considered as limiting.

As used herein, the terms "integral", "unitary", or "monolithic" as used to describe a structure refers to the structure being formed integrally of a continuous material or group of materials with no seams, connections joints, or the like. The integral, unitary structures described herein may be formed through additive manufacturing to have the described structure, or alternatively through a casting process, etc.

The term "unitary" as used herein denotes that the final component has a construction in which the integrated portions are inseparable and is different from a component comprising a plurality of separate component pieces that have been joined together but remain distinct and the single component is not inseparable (i.e., the pieces may be re-separated). Thus, unitary components may comprise generally substantially continuous pieces of material or may comprise a plurality of portions that are permanently bonded to one another. In any event, the various portions forming a unitary component are integrated with one another such that the unitary component is a single piece with inseparable portions.

The term "adjacent" as used herein with reference to two walls and/or surfaces refers to the two walls and/or surfaces contacting one another, or the two walls and/or surfaces being separated only by one or more nonstructural layers and the two walls and/or surfaces and the one or more nonstructural layers being in a serial contact relationship (i.e., a first wall/surface contacting the one or more nonstructural layers, and the one or more nonstructural layers contacting the a second wall/surface.

The term "proximate" refers to being closer to one end than an opposite end. For example, when used in conjunction with first and second ends; high pressure and low pressure sides; or the like, the phrase "proximate the first end," or "proximate the high pressure side," refers to a location closer to the first end than the second end, or closer to the high pressure side than the low pressure side, respectively.

The terms "upstream" and "downstream" refer to the relative direction with respect to fluid flow in a fluid pathway. For example, "upstream" refers to the direction from which the fluid flows, and "downstream" refers to the direction to which the fluid flows. Terms of approximation, such as "about" or "approximately," refer to being within a ten percent margin of error.

The term "turbomachine" refers to a machine including one or more compressors, a heat generating section (e.g., a combustion section), and one or more turbines that together generate a torque output.

The term "gas turbine engine" refers to an engine having a turbomachine as all or a portion of its power source. Example gas turbine engines include turbofan engines, turboprop engines, turbojet engines, turboshaft engines, etc., as well as hybrid-electric versions of one or more of these engines.

The term "combustion section" refers to any heat addition system for a turbomachine. For example, the term combustion section may refer to a section including one or more of a deflagrative combustion assembly, a rotating detonation combustion assembly, a pulse detonation combustion assembly, or other appropriate heat addition assembly. In certain example embodiments, the combustion section may include an annular combustor, a can combustor, a cannular combustor, a trapped vortex combustor (TVC), or other appropriate combustion system, or combinations thereof.

The terms "low" and "high", or their respective comparative degrees (e.g., -er, where applicable), when used with a compressor, a turbine, a shaft, or spool components, etc. each refer to relative speeds within an engine unless otherwise specified. For example, a "low turbine" or "low speed turbine" defines a component configured to operate at a rotational speed, such as a maximum allowable rotational speed, lower than a "high turbine" or "high speed turbine" of the engine.

The terms "forward" and "aft" refer to relative positions within a gas turbine engine or vehicle, and are based on a normal operational attitude of the gas turbine engine or vehicle. More particularly, forward and aft are used herein with reference to a direction of travel of the vehicle and a direction of propulsive thrust of the gas turbine engine.

As used herein, the terms "axial" and "axially" refer to directions and orientations that extend substantially parallel to a centerline of the gas turbine engine. Moreover, the terms "radial" and "radially" refer to directions and orientations that extend substantially perpendicular to the centerline of the gas turbine engine. In addition, as used herein, the terms "circumferential" and "circumferentially" refer to directions and orientations that extend arcuately about the centerline of the gas turbine engine.

A combustor liner of a combustor of a gas turbine engine is typically supported by a support structure. During operation, combustors typically experience variations in temperature. Thus, combustor materials expand when heated, and variations in temperature result in different amounts of thermal expansion or contraction of different portions of the combustor liner. Also, the support structure may have a coefficient of thermal expansion or contraction that is different from the coefficient of thermal expansion or contraction of the combustor liner material. Accordingly, thermal stress may be induced in the combustor liner due to differential expansion within the combustor liner itself and with respect to the combustor liner support structure.

Embodiments of the present disclosure provide a combustor assembly for a gas turbine engine including a plurality of liner tiles defining at least a portion of a combustor liner of a combustor of a gas turbine engine. The liner tiles may be metallic or non-metallic. By way of non-limiting example, non-metallic liner tiles may be made from a ceramic material such as a ceramic matrix composite (CMC) material. Embodiments of the present disclosure interlocked together in the axial and/or radial direction using a number of different techniques. In one exemplary embodiment, a cable is used to interlock the liner tiles to each other to define the combustor liner. In another exemplary embodiment, geometric complementary interlocking elements such as protrusions and grooves may be used to interlock the liner tiles in the axial and/or circumferential directions. In another exemplary embodiment of the present disclosure, a combination of knuckles with pins and/or cables may be used to interlock the liner tiles using a hinge-like mechanism. One or more of the interlocking features of the present disclosure may be used in combination to interlock the liner tiles in the axial, radial, and/or circumferential directions.

Referring now to the drawings, wherein identical numerals indicate the same elements throughout the Figures, FIG. 1 is a schematic cross-sectional view of a gas turbine engine 10 in accordance with an exemplary embodiment of the present disclosure. More particularly, for the embodiment of FIG. 1, the gas turbine engine is a high-bypass turbofan jet engine, sometimes also referred to as a "turbofan engine." As shown in FIG. 1, the gas turbine engine 10 defines an axial direction A (extending parallel to a longitudinal axis 12 provided for reference), a radial direction R, and a circumferential direction C extending about the longitudinal axis 12. The longitudinal axis 12 may also correspond to a centerline of the gas turbine engine 10 extending in the axial direction A. In general, the gas turbine engine 10 includes a fan section 14 and a turbomachine 16 disposed downstream from the fan section 14.

The exemplary turbomachine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft 34 (which may additionally or alternatively be a spool) drivingly connects the HP turbine 28 to the HP compressor 24. A low pressure (LP) shaft 36 (which may additionally or alternatively be a spool) drivingly connects the LP turbine 30 to the LP compressor 22. The compressor section, combustion section 26, turbine section, and jet exhaust nozzle section 32 together define a working gas flowpath 37.

For the embodiment depicted, the fan section 14 includes a fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable pitch change mechanism 44 configured to collectively vary the pitch of the fan blades 40, e.g., in unison. The gas turbine engine 10 further includes a power gearbox 46, and the fan blades 40, disk 42, and pitch change mechanism 44 are together rotatable about the longitudinal axis 12 by LP shaft 36 across the power gearbox 46. The power gearbox 46 includes a plurality of gears for adjusting a rotational speed of the fan 38 relative to a rotational speed of the LP shaft 36, such that the fan 38 may rotate at a more efficient fan speed.

Referring still to the exemplary embodiment of FIG. 1, the disk 42 is covered by a rotatable front hub 48 of the fan section 14 (sometimes also referred to as a "spinner"), the front hub 48 aerodynamically contoured to promote an airflow through the plurality of fan blades 40.

Additionally, the exemplary fan section 14 includes an annular fan casing or outer nacelle 50 that circumferentially surrounds the fan 38 and/or at least a portion of the turbomachine 16. It should be appreciated that the outer nacelle 50 is supported relative to the turbomachine 16 by a plurality of circumferentially-spaced outlet guide vanes 52 in the embodiment depicted. Moreover, a downstream section 54 of the outer nacelle 50 extends over an outer portion of the turbomachine 16 so as to define a bypass airflow passage 56 therebetween.

During operation of the gas turbine engine 10, a volume of air 58 enters the gas turbine engine 10 through an associated inlet 60 of the outer nacelle 50 and fan section 14. As the volume of air 58 passes across the fan blades 40, a first portion of air 62 is directed or routed into the bypass airflow passage 56 and a second portion of air 64 is directed or routed into the working gas flowpath 37, or more specifically into the LP compressor 22. The ratio between the first portion of air 62 and the second portion of air 64 is commonly known as a bypass ratio. A pressure of the second portion of air 64 is then increased as it is routed through the HP compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft 34, thus causing the HP shaft 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft 36, thus causing the LP shaft 36 to rotate, thereby supporting operation of the LP compressor 22 and/or rotation of the fan 38.

The combustion gases 66 are subsequently routed through the jet exhaust nozzle section 32 of the turbomachine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the gas turbine engine 10, also providing propulsive thrust. The HP turbine 28, the LP turbine 30, and the jet exhaust nozzle section 32 at least partially define a hot gas path 78 for routing the combustion gases 66 through the turbomachine 16.

It should be appreciated, however, that the exemplary gas turbine engine 10 depicted in FIG. 1 is by way of example only, and that in other exemplary embodiments, the gas turbine engine 10 may have any other suitable configuration. For example, although the gas turbine engine 10 depicted is configured as a ducted gas turbine engine (i.e., including the outer nacelle 50), in other embodiments, the gas turbine engine 10 may be an unducted gas turbine engine (such that the fan 38 is an unducted fan, and the outlet guide vanes 52 are cantilevered from the outer casing 18). Additionally, or alternatively, although the gas turbine engine 10 depicted is configured as a geared gas turbine engine (i.e., including the power gearbox 46) and a variable pitch gas turbine engine (i.e., including a fan 38 configured as a variable pitch fan), in other embodiments, the gas turbine engine 10 may additionally or alternatively be configured as a direct drive gas turbine engine (such that the LP shaft 36 rotates at the same speed as the fan 38), as a fixed pitch gas turbine engine (such that the fan 38 includes fan blades 40 that are not rotatable about a pitch axis P), or both. It should also be appreciated, that in still other exemplary embodiments, aspects of the present disclosure may be incorporated into any other suitable gas turbine engine. For example, in other exemplary embodiments, aspects of the present disclosure may (as appropriate) be incorporated into, e.g., a turboprop gas turbine engine, a turboshaft gas turbine engine, or a turbojet gas turbine engine.

Figure 2:
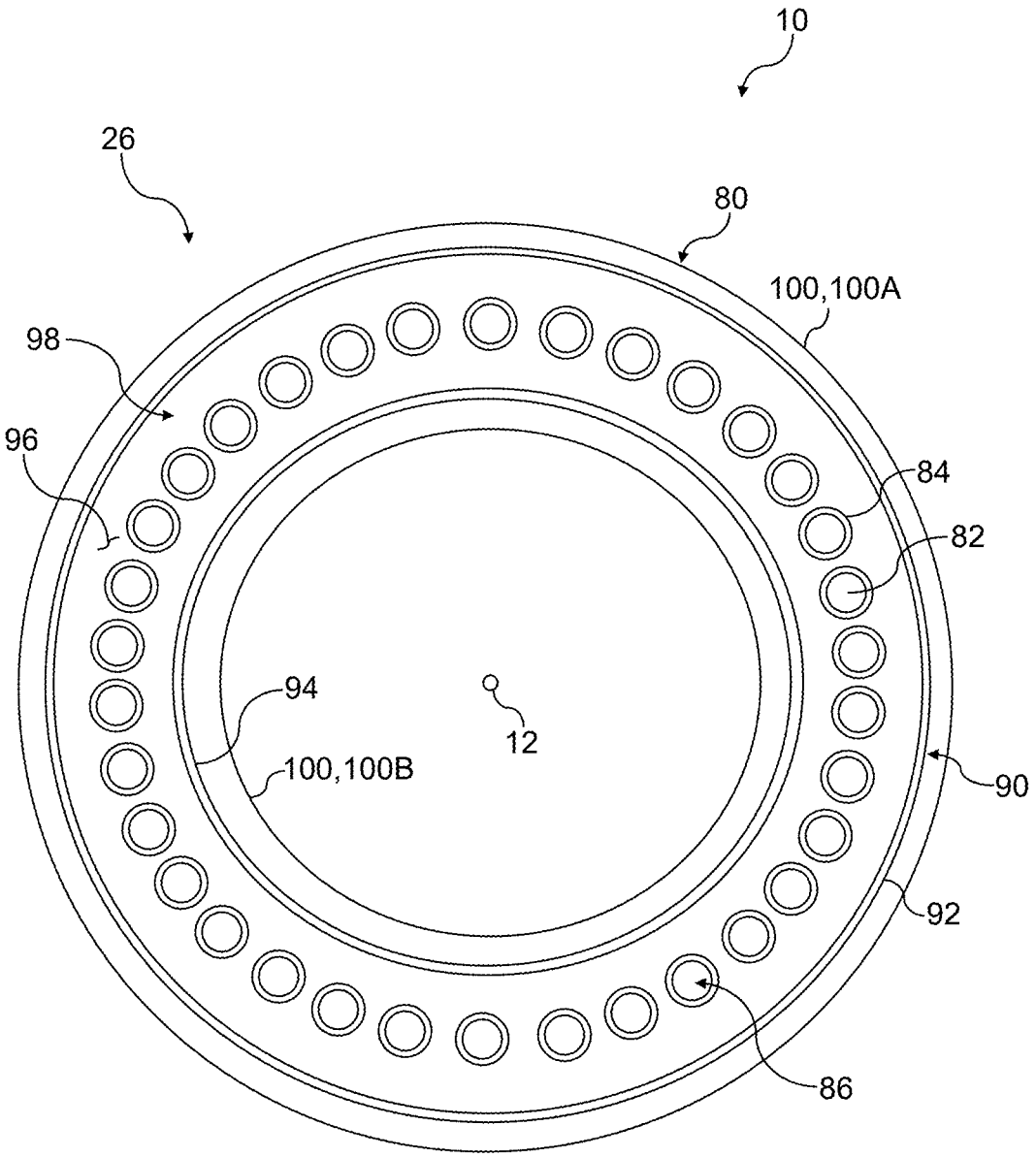
FIG. 2 provides a perspective, axial view of an exemplary combustor assembly in accordance with an exemplary embodiment of the present disclosure.

FIG. 2 is a schematic diagram depicting an axial view of a portion of the combustion section 26 viewed in an axially forward direction. In the embodiment illustrated in FIG. 2, the combustion section 26 includes a combustor assembly 80. The combustor assembly 80 may include a set of fuel injectors 82 annularly arranged about the longitudinal axis 12 of the gas turbine engine 10. A combustor 84 is fluidly connected to the set of fuel injectors 82 to define at least a portion of a set of fuel cups 86 annularly provided about the longitudinal axis 12.

A combustor liner 90 including an outer combustor liner 92 and an inner combustor liner 94 concentric with respect to each other and annular about the longitudinal axis 12 defines the combustor 84. The combustor liner 90 also further defines the set of fuel cups 86. A dome wall 96 together with the combustor liner 90 can define a combustion chamber 98 of the combustor 84 annular about the longitudinal axis 12. The set of fuel cups 86 can be fluidly coupled to the combustion chamber 98.

The combustor 84 can have a can, can-annular, or annular arrangement depending on the type of engine in which the combustor 84 is located. The combustor liner 90 can also have a varying geometry. The outer combustor liner 92 and the inner combustor liner 94 may each be supported by a combustor liner support assembly 100. In the embodiment illustrated in FIG. 2, the outer combustor liner 92 is supported by a combustor liner support assembly 100A, and the inner combustor liner 94 is supported by a combustor liner support assembly 100B.

Figure 3:
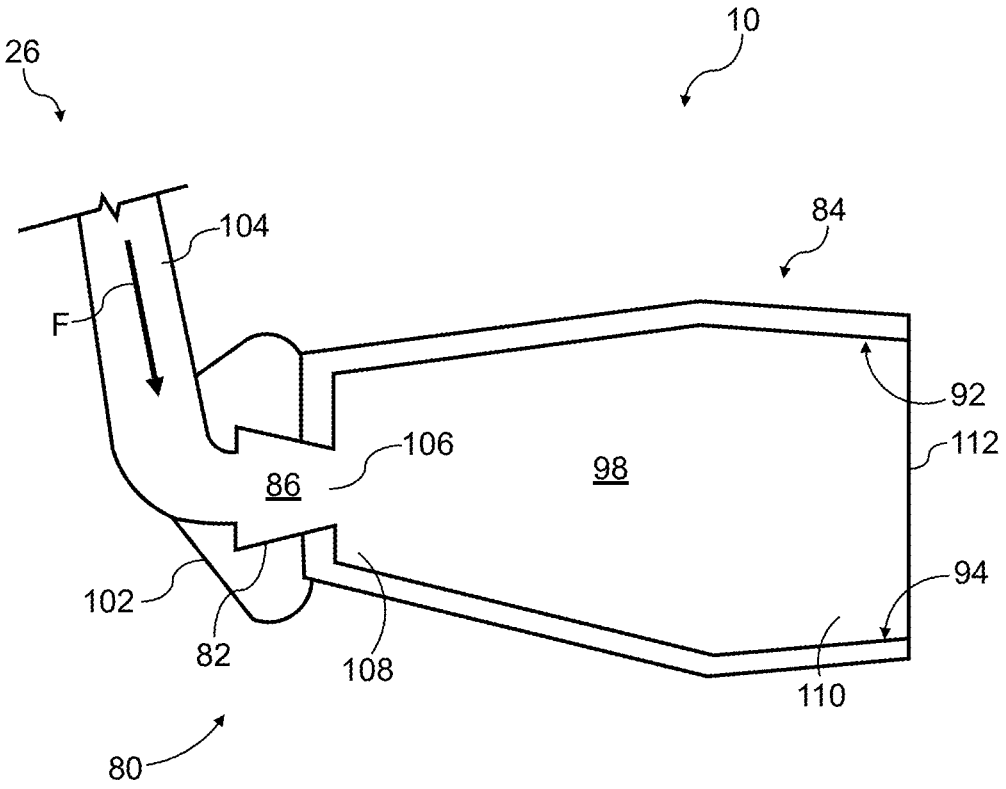
FIG. 3 is a schematic, side view of an exemplary combustor assembly in accordance with an exemplary embodiment of the present disclosure.

FIG. 3 depicts a schematic, side view of a portion of the combustion section 26. A dome assembly 102 can house the fuel injector 82. The fuel injector 82 can be fluidly coupled to a fuel passageway 104 that is configured to receive a flow of fuel (F). The fuel injector 82 can terminate in a dome inlet 106 to define the fuel cup 86. The combustor 84 includes the combustion chamber 98 extending axially from a forward end 108 proximate to the dome inlet 106 to an aft end 110 proximate to a combustor outlet 112 and at least partially defined by the outer combustor liner 92 and the inner combustor liner 94.

Figure 4:
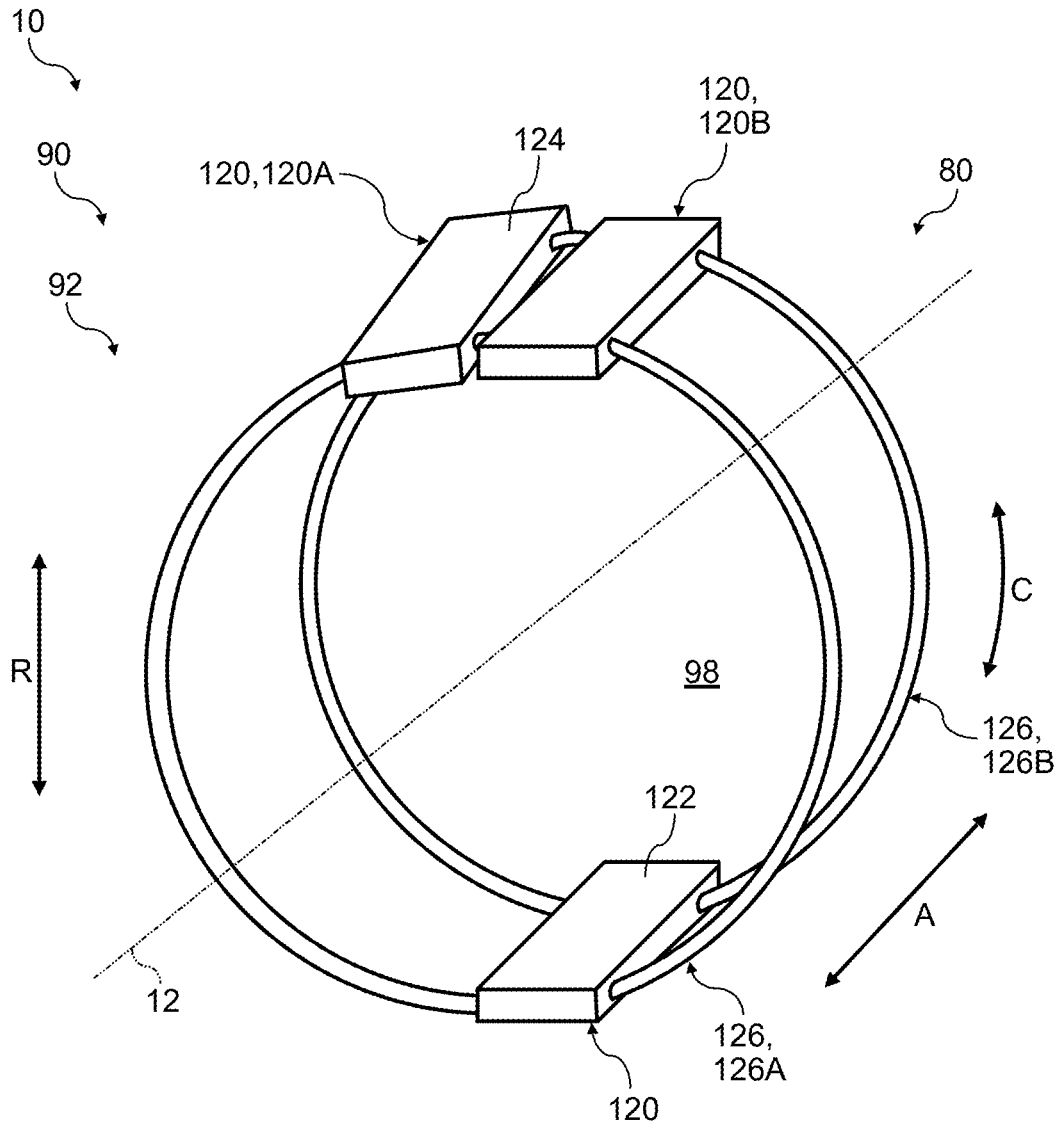
FIG. 4 is a schematic perspective view of a portion of an exemplary combustor assembly in accordance with an exemplary embodiment of the present disclosure.

FIG. 4 is a schematic view of a portion of the combustor assembly 80 in accordance with an exemplary aspect of the present disclosure. The exemplary combustor assembly 80 of FIG. 4 may be configured in substantially the same manner as the exemplary combustor assemblies depicted in previous figures, and accordingly, the same or similar numbers may refer to the same or similar parts. For example, FIG. 4 illustrates the outer combustor liner 92, which is included as part of the combustor liner 90, in combination with a set of liner tiles 120 defining at least part of an axial segment of the combustion chamber 98. However, for the embodiment of FIG. 4, the combustor liner 90 includes an arrangement of liner tiles 120, including individual liner tiles 120A, 120B, secured or interlocked with respect to each and to the combustor liner support assembly 100A (FIG. 2) by one or more cables 126, identified as the cables 126A, 126B in FIG. 4. In this view, only a limited quantity of the liner tiles 120 are depicted for clarity to better illustrate the cables 126. It should be understood that, in exemplary embodiments, additional liner tiles 120 may be positioned circumferentially and/or axially to define the combustion chamber 98.

In the embodiment of FIG. 4, the outer combustor liner 92 includes the plurality of liner tiles 120. Each liner tile 120 is annularly arranged about the longitudinal axis 12 in the circumferential direction C, thereby, in combination, defining at least a part of the circumferential and radial boundaries of the combustion chamber 98. The liner tiles 120 have liner tile inner surfaces 122 facing the combustion chamber 98 and liner tile outer surfaces 124 disposed radially outward relative to the combustion chamber 98. By way of example, the liner tiles 120 may be of metallic or non-metallic composition, such as ceramic matrix composite (CMC) materials, or any other suitable material.

The arrangement of FIG. 4 illustrates the cables 126A, 126B extending substantially in the circumferential direction C about the longitudinal axis 12 of the gas turbine engine 10. The cables 126 are oriented such that they pass through or alongside the liner tiles 120. In the embodiment of FIG. 4, the cables 126 extend substantially 360 degrees of the combustion chamber 98 or substantially the entire circumferential span of the outer combustor liner 92. However, it should be understood that the cables 126 may extend partially in span circumferentially with respect to the outer combustor liner 92 to engage a set of the liner tiles 120. In the embodiment illustrated in FIG. 4, two cables 126A, 126B are depicted. However, a greater or fewer quantity of cables 126 may be used. As used herein, the term "cable" shall mean an elongated flexible or semi-flexible structure capable of supporting a structure in tension. It should also be appreciated that the term "cable" should not limit the types of materials or structures used for constructing the cable 126. The term "cable" is used broadly to merely describe any type of flexible tensile member having sufficient strength to withstand a load. The cable 126 may be a single solid structure, such as a solid wire or strap, or may be a multi-strand or braided construction of small diameter elements, such as a braided rope cable. The cable 126 may be circular in cross-section or have another cross-sectional shape.

The liner tiles 120 are positioned adjacent each other in the circumferential direction C, with the cables 126 providing a restraining function by coupling the liner tiles 120 in series. For instance, as illustrated in FIG. 4, liner tile 120A is positioned circumferentially next to liner tile 120B and both are secured by the cables 126A and 126B. The cables 126 can extend through dedicated channels or openings within each liner tile, such as through an internal channel defined within the body of the liner tile 120. In another exemplary embodiment, each cable 126 may be arranged to extend along an outer surface of the liner tile 120 instead of through an internal channel of the liner tile 120, depending on the design requirements and material properties of the liner tile 120 and/or the cable 126.

The combustor liner 90 can include multiple such cables 126 positioned in a parallel or offset relationship in the axial direction A. In an exemplary embodiment, multiple cables 126 may be spaced apart from each other and engage different, spaced apart portions of the liner tile 120. By way of non-limiting example, the cable 126A can be located nearer the forward end of the liner tile 120, while the cable 126B may be disposed closer to the aft end of the liner tile 120. This configuration provides independent circumferential restraint for different segments of each liner tile 120 and beneficially addresses the effects of thermal gradients along the liner tile 120 length.

The use of cables 126 that extend substantially 360 degrees in the circumferential direction enables the collective engagement and retention of all the liner tiles 120 defining the combustion chamber segment in the illustrated ring. In exemplary embodiments, the cables 126 may be constructed as pre-strained cables. This pre-straining can improve the likelihood of the liner tiles 120 being urged radially or circumferentially into engagement with adjacent liner tiles 120 and/or supporting structure, though pre-straining is not required in every application.

In another exemplary embodiment, the cables 126 can be routed such that the ends of each cable terminate at a common circumferential location. Alternatively, the cables may terminate at different circumferential points or may be configured to permit access for installation and removal at service intervals. The selection of each cable 126 routing and termination arrangement may depend on combustor geometry, serviceability, and engine type.

Additionally, the illustrated arrangement permits the liner tiles 120 to expand or contract independently in response to thermal cycling, since the cables 126, when compared to rigid fasteners, provide a flexible retaining system. This flexibility can allow for controlled movement of each liner tile 120 within defined limits, thereby improving durability by reducing undesired thermally-induced stress concentrations at the tile joints.

Alternative embodiments may vary the number or placement of the liner tiles 120 around the circumference or may alter the liner tile 120 dimensions to suit specific combustor designs. For example, a greater or lesser number of circumferential liner tiles 120 may be used, and the shape of each liner tile 120 may be rectangular, trapezoidal, or of another geometry. The cables 126 themselves may have different cross-sectional forms, e.g., round, flat, or otherwise profiled, tailored to the thermal and mechanical needs of the combustor assembly.

In exemplary embodiments, the liner tiles 120 may include further features to interface with adjacent liner tiles 120 or to direct cooling air between the outer combustor liner 92 and the respective liner tile outer surfaces 124. For example, the liner tiles 120 may be provided with cooling passages, bosses, or raised lands to enhance thermal regulation or promote an improved fit with the support assembly.

The number of cable sets (e.g., cables 126A and 126B) and the arrangement thereof may be adjusted to match the thermal expansion and movement characteristics of other combustor liner support features. By way of example, in applications requiring greater axial support or redundancy, additional cables or wire forms may additionally extend in the axial direction to secure the liner tiles 120 both axially and circumferentially.

While FIG. 4 depicts an exemplary outer combustor liner 92 configuration, it is understood that the same or similar cable- and tile-securing arrangements may be applied to the inner combustor liner 94 (FIG. 2). Moreover, the described cable and tile liner structure is adaptable to can, can-annular, or fully annular combustor types, and may accommodate a variety of fuel injection and dome assembly configurations. Further, the described cable and liner tile structure may extend in other non-circumferential direction such as, by way of non-limiting example, in the axial direction A as will be described and illustrated in the following figures.

The present disclosure also contemplates situations in which cables 126 may be periodically inspected or replaced during engine maintenance procedures. Access to cable ends may be provided through local cutouts or ports in the combustor liner support assembly 100, which are not depicted in FIG. 4 but may be included as needed for maintenance practices.

In alternative designs, the combination of the cables 126, liner tiles 120, and combustor liner support arrangements may be supplemented by additional interlocking features, such as protrusions, grooves, lugs, or other mechanical engagement structures, as appropriate for optimizing liner retention in both the circumferential and axial directions.

In summary, the combustor assembly 80 as illustrated in FIG. 4 provides an arrangement in which a plurality of liner tiles 120, each having the liner tile inner surface 122 and the liner tile outer surface 124, positioned circumferentially to define the combustion chamber 98 and retained by one or more cables 126. The cables 126 may extend in the circumferential direction C to secure each liner tile 120 relative to the combustor liner support assembly 100 (FIG. 2), with the arrangement being compatible with a range of combustor geometries, liner tile materials, and cable engagement strategies as described. This configuration beneficially may improve liner tile 120 retention while accommodating thermal expansion and easing serviceability requirements, without requiring rigid coupling or complicated tile geometries.

Figure 5:
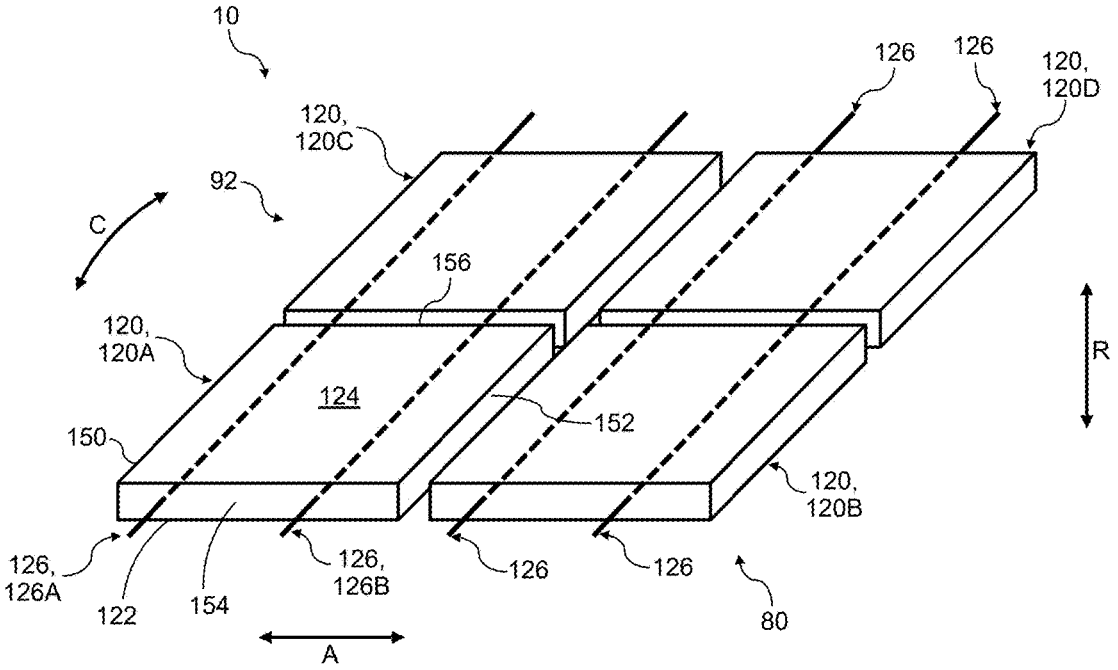
FIG. 5 is a schematic perspective view of a portion of an exemplary combustor assembly in accordance with an exemplary embodiment of the present disclosure.

FIG. 5 is a schematic enlarged diagram of a portion of the combustor assembly 80 in accordance with an exemplary aspect of the present disclosure. The exemplary combustor assembly 80 of FIG. 5 may be configured in substantially the same manner as the exemplary combustor assemblies depicted in previous figures, and accordingly, the same or similar numbers may refer to the same or similar parts. For example, the combustor assembly 80 of FIG. 5 generally includes the plurality of liner tiles 120 defining the combustion chamber 98 (which forms part of a combustor liner 90 for the gas turbine engine 10 (FIG. 1)), and further includes a pair of cables 126 extending circumferentially through each respective axial row of the liner tiles 120. However, for the embodiment of FIG. 5, the arrangement of the liner tiles 120 and the manner in which the cables 126 secure the liner tiles 120 in both axial and circumferential patterns is specifically illustrated.

The liner tiles 120 of FIG. 5 are positioned in a pattern such that a first set of liner tiles 120A, 120B are arranged adjacent each other in the axial direction A, and a second set of liner tiles 120C, 120D are arranged adjacent each other in the circumferential direction C. Each liner tile 120, for example liner tiles 120A, 120B, 120C, and 120D, defines the tile inner surface 122 facing radially inward toward the combustion chamber (not shown in this view), and the tile outer surface 124 opposite the inner surface 122 and facing radially outward. Each liner tile 120 further includes a forward end face 150, an aft end face 152 positioned oppositely along the axial direction A, and circumferential end faces 154, 156 positioned at the lateral bounds along the circumferential direction C.

The arrangement of FIG. 5 illustrates two cables 126, labeled as 126A and 126B, each extending through or adjacent to all liner tiles 120 in a given axial row. In this exemplary embodiment, the cables 126 are oriented so as to pass through a feature internally within a body of each liner tile 120 extending substantially in the circumferential direction C. In this configuration, cable 126A is located closer to the forward end face 150 of each liner tile 120, while cable 126B is situated nearer the aft end face 152. This pair of cables 126 secures each respective tile in the corresponding axial row and provides distributed circumferential retention across the assembly of liner tiles 120.

As shown, liner tiles 120A, 120B, 120C, and 120D are positioned adjacent each other such that respective first and second liner tile circumferential end faces 154, 156 face each other and respective liner tile forward and aft end faces 150, 152 face each other. For example, the liner tile 120A is positioned axially adjacent to the liner tile 120B and circumferentially adjacent to the liner tile 120C. Similarly, the liner tile 120B is positioned adjacent to the liner tile 120D in the circumferential direction C. The illustrated arrangement provides support for configurations in which the liner tiles 120 are interlocked by cable restraint in both the circumferential and axial directions.

In the embodiment of FIG. 5, each of the liner tiles 120 is secured to the combustor liner support assembly 100 (FIG. 2) by at least the pair of cables 126. The cables 126 may extend entirely around the circumference for each axial row of liner tiles 120, engaging with each liner tile 120 in the axial row. This configuration may improve the likelihood of retaining each liner tile 120 in position during thermal cycling and mechanical loading present during engine operation. The location and number of cables 126 may be selected as appropriate to provide sufficient restraint without impeding the thermal or mechanical movement of the liner tiles 120.

In some embodiments, the cables 126 may extend through internal channels formed into each liner tile 120. For example, the cables 126 may pass through features at or below the tile outer surface 124, such as bored passages or machined channels extending between the first and second circumferential end faces 154, 156. By way of non-limiting example, the first cable 126A may pass near the forward end face 150 of each liner tile 120, and the second cable 126B may pass near the aft end face 152 of each liner tile 120. This arrangement allows each cable 126 to engage a linear series of liner tiles 120 positioned adjacently in both the axial and circumferential directions.

Alternative embodiments may provide for the cables 126 to travel along an outer surface of each liner tile 120, instead of through an internal passage. In this arrangement, the cable may be guided by notches, raised lands, or similar features on the tile outer surface 124, which direct the cable along a predetermined path and prevent slippage. This may be beneficial in applications where the liner tile material does not lend itself readily to internal channels, as may be the case for certain types of ceramics or composite materials.

The liner tile end faces 150 (forward), 152 (aft), 154 (first circumferential), and 156 (second circumferential) are shown as substantially planar in FIG. 5. However, other configurations are possible. For instance, the end faces may be provided with keys, steps, or other geometric interlocks to improve mechanical engagement between adjacent tiles. As another example, the end faces may be formed at non-orthogonal angles or curved surfaces relative to the liner tile faces to provide further optimization of tile-to-tile engagement and to manage thermal expansion effects during engine operation.

In some embodiments, the plurality of liner tiles 120 are of a rectangular geometry as depicted, but other shapes are contemplated. For example, the liner tiles 120 may be trapezoidal, polygonal, or fit together in a tessellated arrangement that follows the contour of the combustor liner 90. This may be beneficial in combustor designs where non-uniform tile shapes are desirable to accommodate curvature, cooling flow paths, or localized reinforcement.

Cables 126A and 126B may each be secured at corresponding cable tie mounting blocks (not shown in this view) positioned at a single circumferential location, or at multiple locations spaced apart around the circumference. The selection of cable anchoring points may impact the installation and maintenance process, and may further be optimized for the service environment of the engine.

The relative position of each cable 126 in the axial direction may be selected to optimize restraint for anticipated thermal gradients along the liner tile 120 length. For example, additional cables 126 may be included between cables 126A and 126B to provide further support where necessary. In other embodiments, more than two cables 126 may be used for each axial row of tiles, for instance, three or four, with each being equidistantly distributed between the forward and aft liner tile end faces 150, 152. This can be beneficial in applications with non-uniform temperature distributions or where enhanced redundancy is favored.

The arrangement shown in FIG. 5 is readily adaptable to include features such as cooling holes, airflow passages, or material inserts in the liner tiles 120 without interfering with the cable 126 routing. For instance, cooling passages may be located between or around the cable channels, and the cable location may be modified to allow for such features as appropriate for the specific application.

Where cable pre-strain is employed, the cables 126 may be installed under tension to urge adjacent tiles 120 into engagement with one another along the first and second circumferential liner tile end faces 154, 156. This pre-load may be beneficial for reducing gaps or movement under service conditions; however, it is not required and may be omitted or varied according to requirements.

The use of two distinct cables 126A and 126B positioned axially apart relative to each liner tile 120 provides an example of a distributed support approach. In other embodiments, a single cable 126 or a plurality of cables 126 of differing diameter, construction, or material may be used, depending on the load requirements, engine size, and desired service interval.

While FIG. 5 illustrates a segment including four liner tiles 120A, 120B, 120C, 120D, it is understood that the arrangement extends in both the axial direction A and the circumferential direction C to cover a larger portion or the entire circumference of the combustor liner 90 (FIG. 2). In practical implementation, dozens or hundreds of such tiles may be deployed, each secured by cables 126 as described herein.

Situations may arise in which the liner tiles 120 are removed for inspection, repair, or replacement during maintenance. The cable 126 arrangement of FIG. 5 may improve ease of removal and installation of individual liner tiles 120 as compared to rigid attachment systems, as the cables 126 may be loosened, removed, or flexed to permit access to a selected liner tile 120.

Alternative attachment points for the cables 126, such as local hooks, recesses, or engagement features integral to the combustor liner support assembly 100 (FIG. 2), are also contemplated. These alternative designs may be selected based on assembly processes, available access, or performance requirements.

Overall, the structure depicted in FIG. 5 illustrates a beneficial arrangement for a segmented, cable-secured combustor liner, in which liner tiles 120 are positioned adjacently along both the axial and circumferential directions, and secured to the combustor liner support assembly 100 (FIG. 2) by a plurality of cables 126 extending circumferentially through each respective row of liner tiles 120. This approach enables a flexible and robust attachment strategy, suitable for various combustor designs and operational conditions, with adaptability for materials, tile shapes, cable numbers, and anchoring locations as needed.

Figure 6:
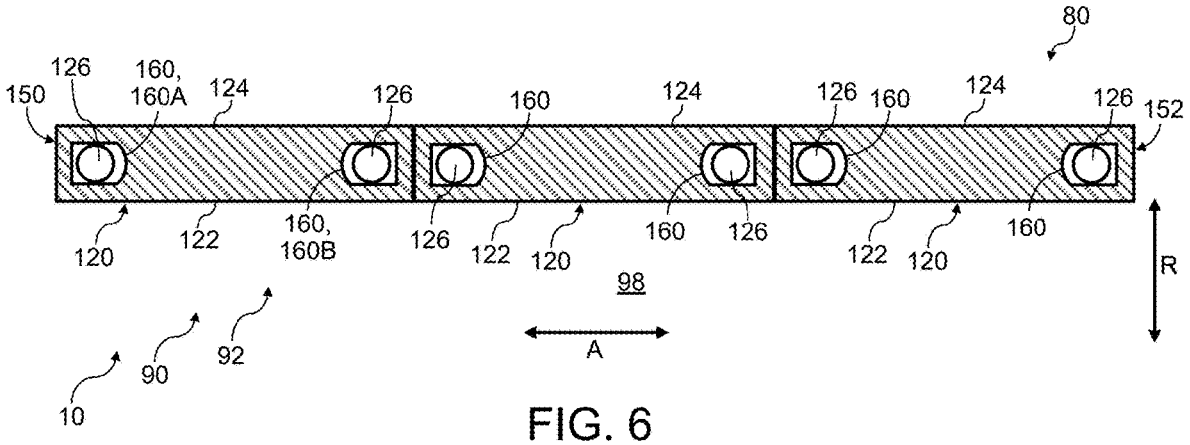
FIG. 6 is a schematic, section view of a portion of an exemplary combustor assembly in accordance with an exemplary embodiment of the present disclosure.

FIG. 6 is a schematic, side section view of a portion of the combustor assembly 80 in accordance with an exemplary aspect of the present disclosure. The exemplary combustor assembly 80 of FIG. 6 may be configured in substantially the same manner as the exemplary combustor assemblies of FIGS. 4 and 5, and accordingly, the same or similar numbers may refer to the same or similar parts. For example, the structure depicted in FIG. 6 generally includes a plurality of the liner tiles 120, and a plurality of the cables 126. However, for the embodiment of FIG. 6, each liner tile 120 defines a pair of internal channels 160, and each cable 126 extends circumferentially through a corresponding channel 160 of at least one liner tile 120 of the plurality of liner tiles 120.

In greater detail, the outer combustor liner 92 of FIG. 6 includes a plurality of liner tiles 120 annularly arranged along the axial direction A. In the illustrated arrangement of FIG. 6, each liner tile 120 includes the tile outer surface 124, the liner tile forward end face 150 and the liner tile aft end face 152. The first and second liner tile circumferential end faces 154, 156 (FIG. 5) are not visible in FIG. 6. The liner tiles 120 are positioned such that their respective liner tile forward end faces 150 and liner tile aft end faces 152 are adjacent and in contact.

In the embodiment of FIG. 6, each liner tile 120 defines a pair of internal channels 160, identified as channels 160A and 160B in one of the liner tiles 120 in FIG. 6, formed within the body of the liner tile 120. In the embodiment illustrated in FIG. 6, the channels 160 and 160B are spaced apart from each other in the axial direction A. These internal channels 160 are indicated schematically in the figure passing through each liner tile 120 in the circumferential direction. A respective cable 126 extends through a respective channel 160 (e.g., the channel 160A that is located nearer the liner tile forward end face 150 of each liner tile 120, and the channel 160B that is located nearer the liner tile aft end face 152) Both channels 160A, 160B are substantially parallel and extend along the circumferential direction C from a first liner tile circumferential end face 154 (FIG. 5) to the second liner tile circumferential end face 156 (FIG. 5) of each liner tile 120.

This arrangement, in which two internal channels 160 are defined in each liner tile 120, permits two separate cables 126 to pass through the liner tile 120 in a circumferential path. In the illustrated example of FIG. 6, each cable 126 passes entirely through at least a portion of the liner tile 120 to connect and secure the liner tiles 120 to each other and to the combustor liner support assembly 100 (FIG. 2). The use of internal channels 160 allows the cables 126 to be routed without interrupting the liner tile outer surface 124 of the liner tiles 120. This preserves the integrity of the thermal protection offered by the liner tile 120 and avoids exposing the cable 126 to direct impingement by combustion gases present within the combustion chamber 98 (FIG. 4).

Examples of suitable internal channels 160 include linear or non-linear bores formed parallel to the liner tile outer surface 124 of the liner tile 120, located at a depth optimized for strength and temperature exposure. In one arrangement, the channels 160 are cylindrical bores formed during manufacture. In another arrangement, the channels 160 may be non-circular or may include a liner or sleeve to limit wear between the cable 126 and the channel 160. The location of each internal channel 160 may be selected based on the expected thermal gradient along the axial (forward-to-aft) length of the liner tile 120.

In some embodiments, the cables 126 are routed such that they extend continuously through the entire axial ring of liner tiles 120 in a path concentric and corresponding to the liner tile outer surfaces 124. This may improve the likelihood of securing the liner tiles 120 against out-of-plane displacement and may allow each cable 126 to restrain more than one axial or circumferential row of liner tiles 120, if desired.

Each cable 126 may be inserted through the internal channel 160 from one end face of the tile liner 120 to the other. The ends of each cable 126 may terminate at a cable tie mounting block (not shown in this view) or may be anchored in any suitable manner to the combustor liner support assembly 100A (FIG. 2). For instance, as described in other embodiments, the ends may terminate at a single circumferential location or may be spaced apart, depending on installation and maintenance preferences.

The use of two cables 126 per liner tile 120, each routed through separate internal channels 160, is an example of a configuration that provides distributed retention across both the forward and aft portions of the liner tiles 120. Such arrangements may be adapted by increasing the number of cables 126 or channels 160 in the liner tile 120 body to suit the needs of the combustion section. For example, for wider liner tiles 120 or higher temperature applications, three or more cables 126 may be routed through additional internal channels 160. Further, it should be understood that although two separate and axially spaced apart channels 160 are depicted in FIG. 6 (e.g., channels 160A, 160B), it should be understood that the liner tile 120 may be configured with a single channel 160 extending axially a sufficient distance to accommodate a plurality of the cables 126 to extend therethrough, spaced apart from each other in the axial direction A or in contact with each other. Alternative embodiments may use a single cable 126 routed through only one internal channel 160 in each liner tile 120. For instance, in applications where space constraints or weight reduction are favored, a single cable 126 may be extended through the series of liner tiles 120. In another example, the cable 126 may extend through non-linear paths if desired, such as undulating or segmented paths, provided the channels 160 are contoured appropriately.

The internal channels 160 may extend from the first circumferential liner tile end face 154 (FIG. 5) to the second circumferential liner tile end face 156 (FIG. 5) of each liner tile 120, supporting cable 126 routing around the full circumference of the combustor liner 90. For instance, in a typical arrangement, each cable 126 may extend substantially 360 degrees in the circumferential direction C, thus securing an entire axial row of liner tiles 120 to the combustor liner support assembly 100A (FIG. 2). This configuration may improve ease of installation and service, as the cable 126 may be inserted or withdrawn circumferentially without disturbing other liner tiles 120.

Depending on design requirements, the diameters and surface finishes of the internal channels may be optimized for cable 126 installation and long-term wear resistance. For example, the internal channel 160 may include a low-friction insert or coating to facilitate movement of the cable 126 during thermal cycling or maintenance operations.

The embodiment of FIG. 6 also illustrates the relative positions of the liner tile end faces 150 (forward), 152 (aft). The illustrated arrangement may be adapted for liner tiles 120 of different shapes, sizes, or materials. For instance, liner tiles 120 with non-rectangular planforms such as trapezoidal or polygonal shapes may be used, with the internal channels 160 angled or curved to follow the circumferential orientation required.

It is contemplated that the axial and circumferential positioning of the cables 126 and internal channels 160 may be selected to provide the desired balance between liner tile 120 retention, thermal accommodation, manufacturability, and serviceability. For example, the axial spacing between the cables 126 may be increased or decreased in different combustor segments to address localized mechanical or thermal considerations.

In some configurations, the cables 126 may be installed under tension, but the use of cable pre-strain is considered optional and may be omitted or modified based on the application. The internal channel 160 arrangement may help control movement of the liner tiles 120 while still allowing for limited expansion or contraction in response to thermal gradients.

The liner tile 120 arrangement shown in FIG. 6 enables multiple liner tiles 120, positioned adjacent each other, to be secured circumferentially by cables 126 extending through dedicated internal channels 160. This may facilitate both initial assembly and later disassembly for maintenance or inspection. For example, one or more adjacent liner tiles 120 may be removed individually by withdrawing the cables 126 from the internal channels 160 without disturbing the entire row of liner tiles 120.

The internal channel 160 and cable 126 configuration illustrated in FIG. 6 may be beneficial in applications with elevated combustion chamber 98 temperatures or where minimization of exposed structural hardware is favored. By shielding the cables 126 from the combustion environment, the risk of cable 126 degradation may be reduced, though supplemental protective coatings or novel cable materials may be implemented as required for specific applications.

While the embodiment of FIG. 6 depicts two cables 126, each routed through a corresponding channel 160 within the liner tiles 120, further variations are contemplated. For example, in designs where greater redundancy is favored, additional channels 160 and cables 126 may be implemented. Conversely, the illustrated arrangement may be used for only a portion of the combustor liner 90, with other retention strategies used elsewhere.

Overall, the embodiment shown in FIG. 6 demonstrates a combustor assembly 80 in which a plurality of liner tiles 120, each defining a pair of internal channels 160, are positioned adjacent each other, and where cables 126 extend circumferentially through each channel 160 to secure the liner tiles 120 to the combustor liner support assembly 100A (FIG. 2). This structure may improve the likelihood of retaining liner tiles 120 under varying operational conditions, while permitting flexibility for alternative channel configurations, cable arrangements, and manufacturing approaches.

Figure 7:
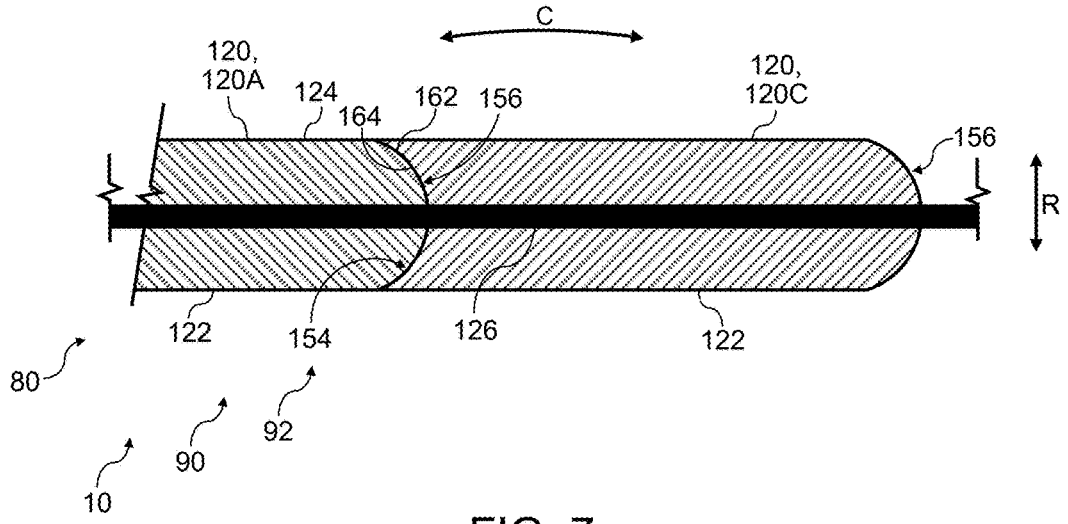
FIG. 7 is a schematic, section view of a portion of an exemplary combustor assembly in accordance with an exemplary embodiment of the present disclosure.

FIG. 7 is a schematic section, side view of a portion of the combustor assembly 80 of a gas turbine engine 10 in accordance with an exemplary aspect of the present disclosure. The exemplary combustor assembly 80 of FIG. 7 may be configured in substantially the same manner as the exemplary assemblies of FIGS. 4-6, and accordingly, the same or similar numbers may refer to the same or similar parts. In the embodiment of FIG. 7, each liner tile 120 further includes interface elements, such as geometric complementary interlocking features, to interlock adjacent liner tiles 120 in the circumferential and radial directions.

In the embodiment of FIG. 7, the liner tiles 120A, 120C are positioned adjacent each other in the circumferential direction C, with the cable 126 also extending in the circumferential direction C. The liner tile 120A includes an interface element 162 at its second liner tile circumferential end face 156, and the liner tile 120C includes an interface element 164 at its first liner tile circumferential end face 154. In the embodiment illustrated in FIG. 7, the interface element 162 defines a curved protrusion, and the interface element 164 defines a geometric complementary curved slot. The protrusion of the liner tile 120A is received within the slot of the liner tile 120C, thereby enabling the liner tiles to physically engage and interlock along the circumferential direction C. In this embodiment of FIG. 7, the protrusion and slot have a curved profile, though alternative profiles such as linear, stepped, or wedge shapes may also be used, depending on desired assembly and retention characteristics. The protrusion interface element 162 is dimensioned and contoured so as to correspondingly fit within the interface element 164, thereby enabling mechanical engagement and interlocking between the two adjacent liner tiles 120A, 120C. This type of interface promotes load transfer between the liner tiles 120A, 120C, distributing mechanical loads and potentially improving alignment during assembly. For example, the engagement of a curved protrusion within a curved slot may improve the likelihood of preventing relative displacement between the liner tiles 120A, 120C in both the circumferential and radial directions.

Alternative geometric configurations for the interface elements 162, 164 are contemplated. As one example, the protrusion may have a rectangular, triangular, or stepped cross-section, and the slot may be configured to closely receive that shape for increased contact area or specific load-bearing characteristics. As another example, multiple protrusions and slots may be spaced axially or radially along the circumferential end faces to provide additional interlocking features. In such arrangements, the increased number or complexity of interlocks may further restrain the tiles relative to each other and reduce potential for local misalignment.

In some embodiments, the interface elements may not be limited to a single pair of protrusion and slot per liner tile 20 end face. Multiple protrusions and corresponding slots may be included, with the features extending in partially staggered or offset arrangements to tailor the degree of restraint, assembly ease, or thermal compliance between the tiles. For example, two or more protrusions may be provided on the first circumferential end face of the liner tile 120, matched by two or more slots on the adjacent second circumferential end face of the adjoining liner tile 120. Furthermore, the interface elements may be formed as discontinuous or non-uniform shapes to influence the local mechanical interaction between the liner tiles 120.

The interface elements 162, 164 may improve the likelihood of preventing unwanted radial displacement of the liner tiles 120A, 120C under the influence of combustion pressure or during transient thermal conditions. However, the dimensions, curvature, and fit of the interface elements 162, 164 may be modified as appropriate for each application. In other exemplary embodiments, the interface elements 162, 164 may be configured with a defined clearance, permitting limited movement to accommodate thermal expansion or differential growth of adjacent liner tiles 120. Alternatively, a close-fit, or even an interference fit, may be implemented if beneficial for the operational environment. The level of engagement and the selected clearances may be tailored according to the desired balance between thermal compliance and restraint.

While the embodiment of FIG. 7 is described in the context of a two-tile interface (i.e., liner tiles 120A and 120C), the method of including geometric complementary interlocking features at the circumferential end faces is extendable to a full circumferential ring of liner tiles 120 about the combustor liner 90. In this arrangement, the plurality of liner tiles 120, each with a protrusion and slot at the respective circumferential ends, may be serially assembled until a closed ring is formed around the combustor. In some cases, the last tile installed may have a removable or clevis-style feature to accommodate assembly.

Figure 8:
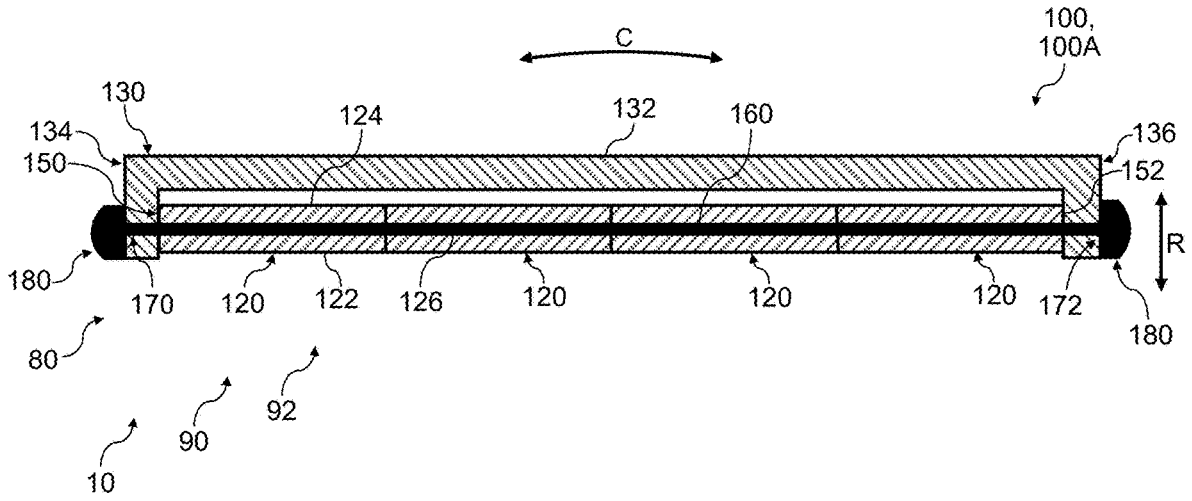
FIG. 8 is a schematic, section view of a portion of an exemplary combustor assembly in accordance with an exemplary embodiment of the present disclosure.

FIG. 8 is a schematic side sectional view of a portion of the combustor assembly 80 in accordance with an exemplary aspect of the present disclosure. The exemplary combustor assembly 80 of FIG. 8 may be configured in substantially the same manner as the exemplary assemblies shown and described with respect to FIGS. 4-7, and accordingly, the same or similar numbers may refer to the same or similar parts. For the embodiment of FIG. 8, a combustor liner support shell 130 defines oppositely positioned support flanges, indicated as a first support shell radial flange 134 and a second support shell radial flange 136 in FIG. 8, each extending radially inwardly from a support shell panel 132 of the combustor liner support shell 130. The cable 126 is depicted extending in the circumferential direction C. The cable 126 defines oppositely positioned, spaced-apart first and second ends 170, 172, where the first end 170 engages the first support shell radial flange 134, and the second end 172 engages the second support shell radial flange 136. The first and second ends 170, 172 are secured to the respective first and second support shell radial flange 134, 136 using a corresponding locking element 180.

In greater detail, the combustor liner support assembly 100 of FIG. 8 includes the combustor liner support shell 130 that is generally annular and extends circumferentially about the longitudinal axis 12 (FIG. 1) of the gas turbine engine 10 (FIG. 1). The support shell panel 132 forms the main body portion of the combustor liner support shell 130 positioned radially outward from the plurality of liner tiles 120. The combustor liner support shell 130 may be a continuous structure extending substantially 360 degrees about the combustor liner 90 or may be configured in segments each extending a defined circumferential span less than 360 degrees. Positioned radially inward from the combustor liner support shell 130 is the plurality of liner tiles 120. The cable 126 is depicted in FIG. 8 extending through at least a portion of two or more of the liner tiles 120 and serves to secure the liner tiles 120 relative to the combustor liner support assembly 100A. In the embodiment of FIG. 8, the first and second ends 170, 172 of the cable 126 are engaged directly with the respective first and second support shell radial flanges 134, 136. The cable 126 may extend generally in the circumferential direction C, radially inward of the support shell panel 132 and oriented parallel or following a curvature of the liner tiles 120.

The locking elements 180 may take a variety of forms, such as threaded fasteners, crimped ferrules, pins, or other mechanical anchors configured to secure the first and second ends 170, 172 of the cable 126 to the combustor support shell 130. By way of example, the locking element 180 may be a swaged retaining plug inserted through an aperture provided at each of the first and second support shell radial flanges 134, 136, with the inserted first and second ends 170, 172 of the cable 126 being expanded, deformed, or otherwise fixed in place during installation. In another example, the locking element 180 may include a set screw or clamp that axially restrains the cable 126 against the respective first and second support shell radial flanges 134, 136. The choice of locking element form may be selected based on ease of assembly, anticipated service loads, and maintainability.

It should be noted that the cable 126 is oriented such that its first end 170 and second end 172 are fixed to different, spaced-apart locations of the combustor support shell 130. The first support shell radial flange 134 and the second shell radial flange 136 are positioned axially apart from each other. This spatial separation allows the cable 126 to be installed under axial tension if desired, although pre-straining is not required in every embodiment.

The configuration in FIG. 8 allows for the cable 126 to extend through at least a portion of each liner tile 120 between the respective first and second support shell radial flanges 134, 136, enabling the cable 126 to directly urge each liner tile 120 against an adjacent liner tile 120. This can improve the likelihood of maintaining positional engagement along the circumferential interface between two adjacent liner tiles 120, especially under conditions of thermal cycling, vibration, or dynamic loading. For example, if a thermal gradient were to cause differential expansion among several liner tiles 120, the coupling of the cable 126 to both the first support shell radial flange 134 and the second support shell radial flange 136 via the respective locking elements 180 may aid in preserving liner tile 120 contact and alignment.

Alternative embodiments may vary the relative positioning of the cable ends and the support shell radial flanges. For instance, the first end 170 and the second end 172 of the cable 126 may be attached to axially-spaced locations in the same or opposite circumferential regions of the combustor liner support shell 130. In one example, both ends may terminate at the same support shell radial flange through a looping arrangement or be affixed at locations with a circumferential offset, providing options to accommodate different combustor geometries or service access requirements.

The locking element 180 can include features that permit selective release or adjustment of the cable 126 tension during maintenance. For example, a releasable locking collar or internal wedge may allow the cable 126 to be removed or re-tensioned as part of an overhaul process. In another variant, the locking element 180 may be a non-releasable component, such as a permanently deformed collar or swaged stop, selected for simplicity and reliability when frequent removals are not anticipated.

The combustor liner support shell 130, including the support shell panel 132 and the first and support shell radial flanges 134, 136, define the structure to which the first and second ends 170, 172 of the cable 126 are mounted. For example, in one embodiment, the support shell panel 132 extends continuously in the circumferential direction, with the first and second support shell radial flanges 134, 136 located at nearly a same circumferential location, forming a circumferentially bounded annular support frame. The cable 126 may thus extend from the first support shell radial flange 134 substantially 360 degrees to the second support shell radial flanges 136. However, it should be understood that multiple circumferential segments may be defined as depicted in FIG. 8.

This cable-anchoring arrangement results in each cable 126 defining spaced apart connection points on the combustor liner support assembly 100A, providing direct, spaced-apart retention points for the cable 126 and distributing loads imposed by the cable 126 across the combustor liner support assembly 100A. In some cases, this distribution can beneficially reduce the sensitivity of the cable 126 to local deformation or movement and can improve the durability of both the liner tiles 120 and the supporting structure. For example, if thermal expansion causes growth of the combustor liner support shell 130, the location of the cable 126 anchor points at spaced-apart regions may reduce the accumulation of stresses at a single region and improve thermal compliance.

Multiple cables 126 may be arranged in parallel, with each cable extending from a respective combustor liner support assembly 100A to a corresponding second support shell radial flange 136 in a particular axial zone or segment. For example, several rows of liner tiles 120 may be supported by respective cables 126, each anchored at opposed first and second support shell radial flanges 134, 136 and passing through dedicated channels in the liner tiles 120 arranged in that respective axial position. This arrangement is also beneficial for modularity, as individual liner tile 120 rows or cable 126 assemblies may be removed, replaced, or serviced separate from adjacent rows.

The locking element 180, as depicted, may be implemented as a discrete mechanical device attached to the cable 126, or the first and second ends 170, 172 of the cable 126, and may be directly formed, swaged, or otherwise shaped to create a mechanical engagement with the respective first and second support shell radial flanges 134, 136. For example, in the case of a stranded metal cable, the cable end may be splayed and pressed to form a head larger than the locking hole in the flange, producing positive retention. In fiber composite cables, resin potting or embedded inserts may serve a similar function.

Alternative embodiments may arrange the first and second ends 170, 172 of the cable 126 to terminate at circumferentially offset positions or may be routed such that the cable 126 can loop back and forth or repeatedly between or through the first and second support shell radial flanges 134, 136 multiple times. For example, the cable 126 may extend from the first support shell radial flange 134, pass through several liner tiles 120, and then return to terminate at the second support shell radial flange 136 on the opposite side of the combustor liner support shell 130. Such arrangements may be advantageous for balancing tension, maintenance, or installation requirements.

Figure 9:
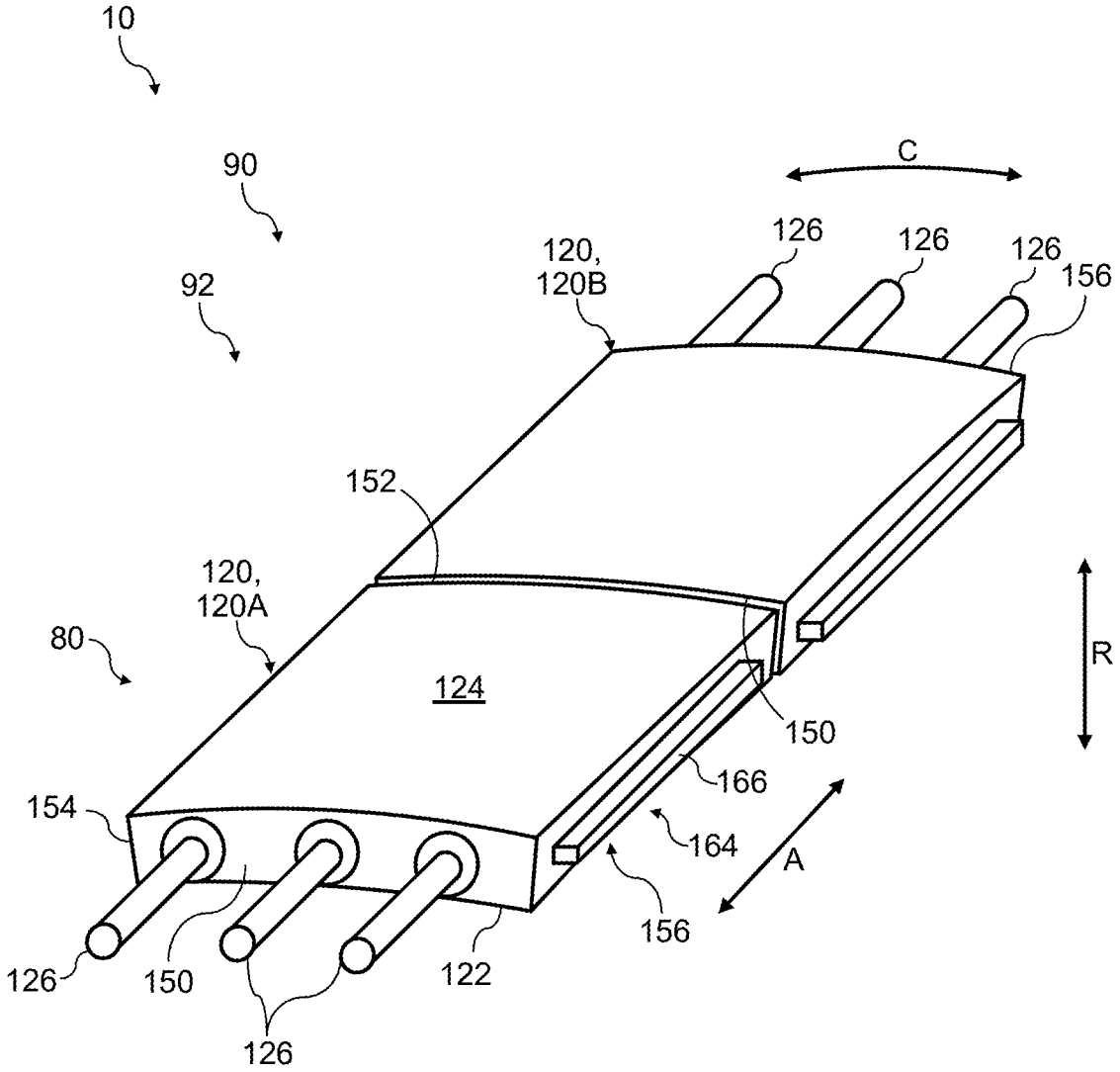
FIG. 9 is a schematic perspective view of a portion of an exemplary combustor assembly in accordance with an exemplary embodiment of the present disclosure.

FIG. 9 is a schematic perspective view of a portion of the combustor assembly 80 in accordance with an exemplary aspect of the present disclosure. The exemplary combustor assembly 80 of FIG. 9 may be configured in substantially the same manner as the exemplary embodiments described with respect to FIGS. 4-8, and accordingly, the same or similar numbers may refer to the same or similar parts. In the embodiment of FIG. 9, the combustor assembly 80 includes three cables 126 extending in the axial direction A to interlock the liner tiles 120A and 120B.

In the embodiment of FIG. 9, the three cables 126 are spaced apart from each other in the circumferential direction C and extend in the axial direction A through portions of the liner tiles 120A and 120B. Each cable 126 passes through respective openings or channels formed at the forward end face 150 of liner tile 120A and continues through the corresponding features in the liner tile 120B. This parallel cable arrangement provides mechanical coupling between the liner tiles 120 in the axial direction A, securing them to the combustor liner support assembly 100A (FIG. 2) and providing restraint against relative movement of the liner tiles 120 in the axial direction A. By interlocking the liner tiles 120 with the cables 126 that extend axially, the design may accommodate variations in liner tile 20 length, width, and orientation for different combustor configurations. It should be understood that a greater or fewer quantity of cables 126 may be used in the axial direction with respect to a particular liner tile 120 or axial row of the liner tiles 120. Thus, the number, spacing, and position of the cables 126 may be modified. For instance, additional cables 126 can be arranged in the axial direction A at uniform or non-uniform spacing, depending on size of the liner tiles 120 and the expected thermal loads. In another arrangement, the cables 126 of different materials or diameters may be used to address localized stress or accommodate different liner tile 120 geometries. The cables 126 can be formed from metallic, ceramic, or composite materials, as appropriate for the combustor temperature environment and expected service intervals.

In the illustrated embodiment of FIG. 9, the interface element 164, in the form of a protrusion 166, is formed on the second liner tile circumferential end face 156 of the liner tiles 120A, 120B. Although only one interface element 164 is depicted in FIG. 9 due to the perspective view of FIG. 9, it is understood that a corresponding groove, channel, or slot (not visible in the present figure) may be formed on the first liner tile circumferential end face 154 of the liner tiles 120A, 120B to engage with an adjacent liner tile 120. The protrusion 166 and the corresponding slot provide geometric complementary interlocking features that are beneficial for mechanically engaging adjacent liner tiles 120 in the circumferential direction C and resisting radial displacement in the radial direction R.

In the embodiment of FIG. 9, the combination of the cable 126 and the circumferential interlocking interface element 164 exemplifies a hybrid retention approach. For instance, the axially-extending cables 126 provide primary restraint in the direction of airflow and combustion gas pressure, while the interlocking protrusion resists radial movement of the liner tiles 120, enhancing positional stability during operation. The presence of the protrusion 166 (and corresponding slot or channel in an adjacent liner tile 120) may also assist in load transfer among liner tiles 120 and may improve the likelihood of reducing relative misalignment or gapping that can otherwise occur due to differential thermal expansion. This arrangement may also be beneficial for maintaining a continuous hot gas path surface within the combustion chamber.

In some applications, the axial cables 126 may be installed under tension, thereby urging the liner tiles 120A, 120B into engagement and helping to maintain contact among adjacent liner tiles 120. The level of pretension applied may be selected based on the expected thermal gradients, expansion allowances, or desired retention force, and is not required for every application.

It is further contemplated that the liner tile forward and aft end faces 150, 152 and first and second liner tile circumferential end faces 154, 156 of each liner tile 120 may be shaped to optimize contact and load transfer, for example, by forming the faces at angles non-orthogonal to the centerline of the gas turbine engine or by including surface treatments, coatings, or fillets to improve fit and reduce wear.

Figure 10:
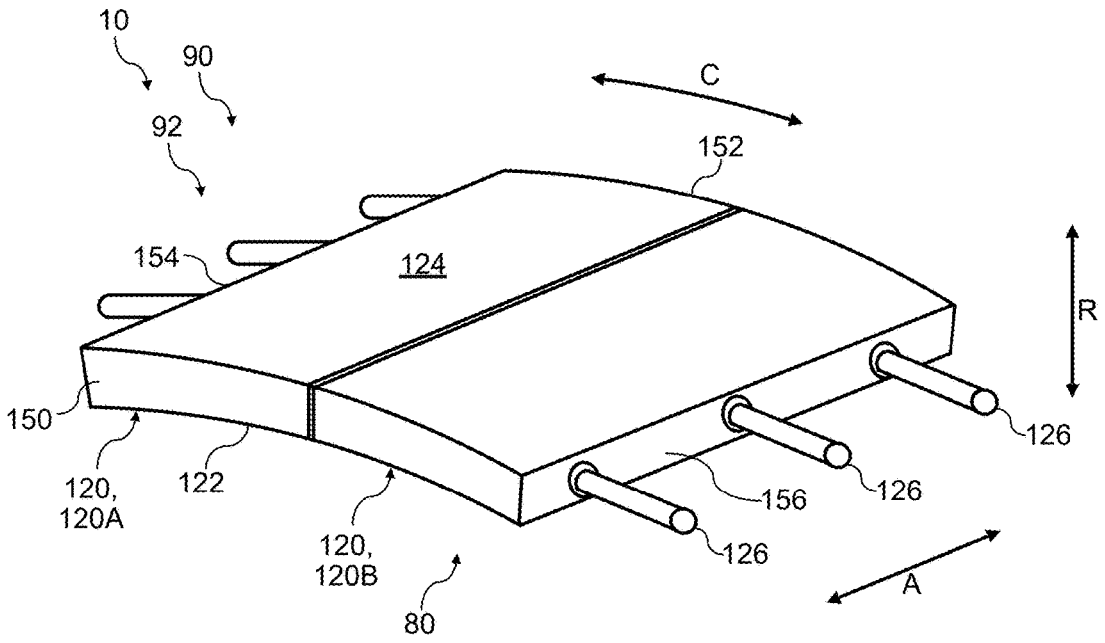
FIG. 10 is a schematic perspective view of a portion of an exemplary combustor assembly in accordance with an exemplary embodiment of the present disclosure.

FIG. 10 is a schematic perspective diagram of a portion of the combustor assembly 80 in accordance with an exemplary aspect of the present disclosure. The exemplary combustor assembly 80 of FIG. 10 may be configured in substantially the same manner as the combustor assemblies depicted in FIGS. 4-9, and accordingly, the same or similar numbers may refer to the same or similar parts. In the embodiment of FIG. 10, the cables 126 extend through at least a portion of the liner tiles 120 in the circumferential direction C.

Figure 11:
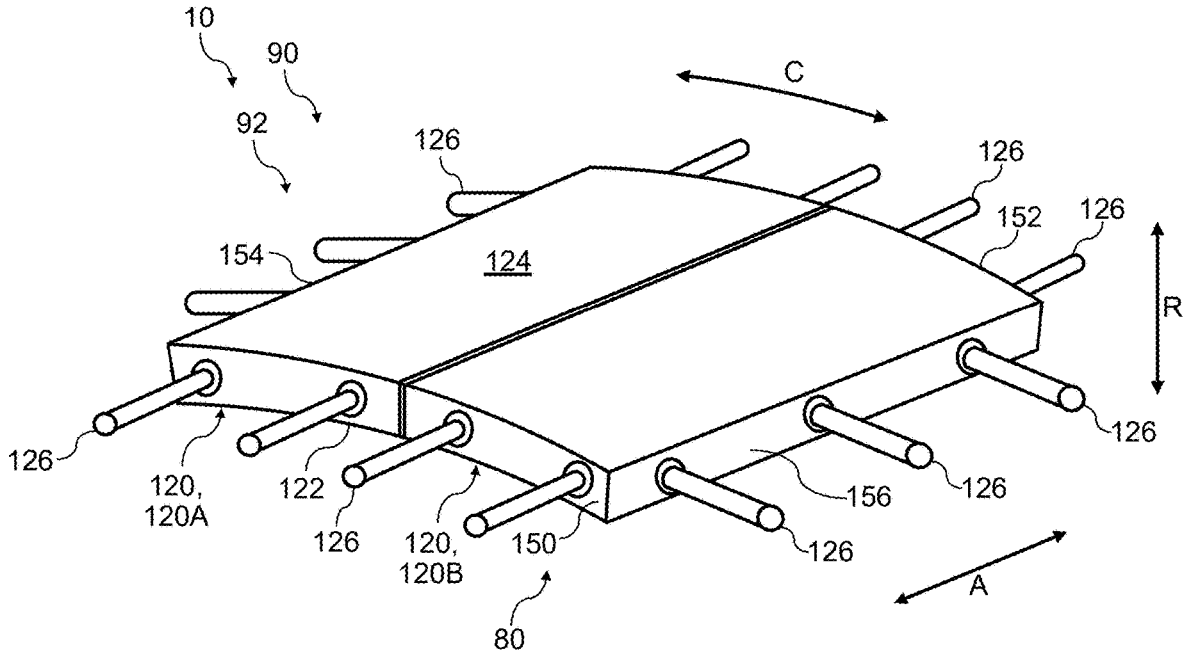
FIG. 11 is a schematic perspective view of a portion of an exemplary combustor assembly in accordance with an exemplary embodiment of the present disclosure.

FIG. 11 is a schematic perspective diagram of a portion of the combustor assembly 80 in accordance with an exemplary aspect of the present disclosure. The exemplary combustor assembly 80 of FIG. 11 may be configured in substantially the same manner as the exemplary combustor assemblies depicted in FIGS. 4-10, and accordingly, the same or similar numbers may refer to the same or similar parts. In the embodiment of FIG. 11, a first set of the cables 126 extends through at least a portion of one or more liner tiles 120 in the axial direction A, and a second set of the cables 126 extends through at least a portion of one or more liner tiles 120 in the circumferential direction C. This dual cable 126 arrangement is illustrated as securing the liner tiles 120 relative to one another and to the combustor liner support assembly 100A (FIG. 4), thereby providing restraint in both primary orientation directions and beneficially addressing multidirectional retention requirements.

In the illustrated embodiment of FIG. 11, the combustor liner 90 includes the liner tiles 120A, 120B, which are positioned immediately adjacent to one another along the circumferential direction C. Each liner tile 120A, 120B of FIG. 11 may include one or more axial channels (e.g., such as the channel 160 (FIG. 6)—not explicitly labeled in FIG. 11) and one or more circumferential channels (e.g., such as the channel 160 (FIG. 6)—not explicitly labeled in FIG. 11), with each channel dimensioned to receive a respective cable 126. The channels may intersect each other within a body of the liner tile 120 or may be located at different depths of the liner tile 120 such that axial channels do not intersect with circumferential channels. In one example, three cables 126 pass in the axial direction at evenly spaced positions between the forward and aft end faces 150, 152, while another set of three cables 126 extends through circumferentially aligned channels running from the first circumferential end face 154 to the second circumferential end face 156.

The dual cable arrangement depicted in FIG. 11 enables each liner tile 120 to be simultaneously restrained along both the axial and circumferential directions. This may improve the likelihood of maintaining positional stability under complex loading conditions, for instance, when differential thermal expansion occurs during operation of the gas turbine engine 10 (FIG. 1). In some embodiments, the cables 126 may be tensioned during installation to urge the liner tiles 120 into contact with each other along both the axial and circumferential directions, thereby limiting relative displacement or vibration that may otherwise occur as a result of combustion gas flow, vibration, or transient temperatures. Furthermore, the combination of axial and circumferential cables 126 may be beneficial in accommodating non-uniform thermal gradients. For example, if the combustion chamber exhibits elevated temperatures in one region compared to another, the independent movement permitted by the cable-retained liner tiles 120 may reduce thermally-induced stress or deformation of both individual liner tiles 120 and the combustor assembly 80 as a whole. This configuration may also provide flexibility to optimize the locations of cooling passages, air film features, or material transitions in the liner tile outer surface 124, as the retention mechanism does not rely on rigid fastener attachment.

The arrangement depicted in FIG. 11 is also compatible with other interlocking features disclosed elsewhere in the present application, such as geometric complementary interface elements on the liner tile circumferential or axial end faces. For example, the interface elements 162, 164 (FIG. 7) such as, by way of non-limiting example, protrusion and slot geometric complementary features, may be provided on the liner tiles 120 to engage a corresponding feature in an adjacent liner tile 120, thereby enhancing mechanical restraint in directions not addressed by the cables 126 alone. Such combinations of mechanical and cable retention strategies may provide added robustness and design flexibility for the combustor assembly 80.

It is contemplated that the number and placement of the cables 126, whether oriented axially or circumferentially, may be independently adjusted for different axial rows or circumferential rings of liner tiles 120 throughout the combustor liner 90. For example, in one segment of the combustor liner 90, a higher cable 126 density may be implemented, while in another, more remote segment, fewer cables 126 may be used. In addition, mixed cable routing geometries, such as cables 126 passing at oblique angles or along segmented paths, are also compatible with the arrangement of FIG. 11.

Figure 12:
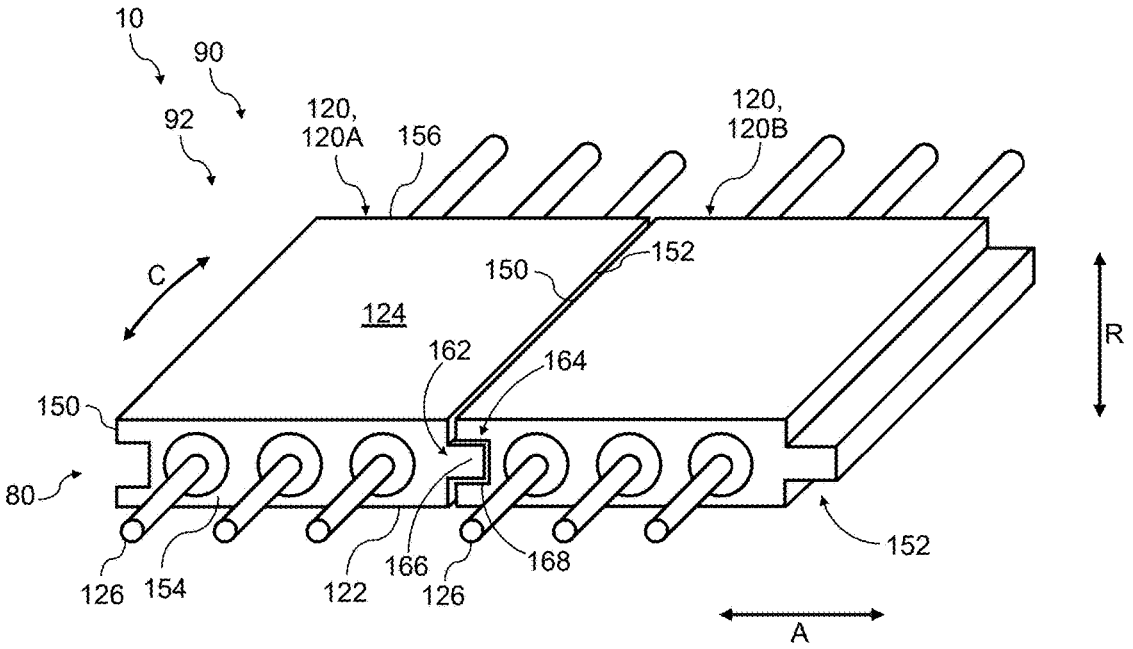
FIG. 12 is a schematic perspective view of a portion of an exemplary combustor assembly in accordance with an exemplary embodiment of the present disclosure.

FIG. 12 is a schematic perspective diagram of a portion of the combustor assembly 80 in accordance with an exemplary aspect of the present disclosure. The exemplary combustor assembly 80 of FIG. 12 may be configured in substantially the same manner as the exemplary combustor assemblies depicted in previous figures, and accordingly, the same or similar numbers may refer to the same or similar parts. In the embodiment of FIG. 12, each liner tile 120 includes the forward end face 150 and the aft end face 152, and the forward and aft end faces 150, 152 include respective interface elements 162, 164 having geometric complementary interlocking features. In this configuration, the interface elements 162, 164 are arranged such that the aft end face 152 of the liner tile 120A includes a protrusion 166, and the forward end face 150 of the adjacent liner tile 120B includes a slot 168 dimensioned to receive the protrusion 166. One or more cables 126 extend through the liner tiles 120 in the circumferential direction C.

At the interface between the liner tiles 120A and 120B, the respective forward and aft end faces 150, 152 are configured with geometric complementary interlocking features. In this embodiment, the aft end face 152 of liner tile 120A includes the protrusion 166, while the forward end face 150 of the liner tile 120B defines the slot 168. The protrusion 166 is sized and shaped to fit within the slot 168 such that, when assembled, the interlock restricts relative movement between adjacent liner tiles in the radial direction R. The mechanical engagement, in this embodiment, is provided in the form of a geometric complementary interlocking feature, which may include a variety of profile shapes, such as rectangular, dovetail, or curvilinear forms, depending on application or manufacturing preference.

Such an interlock between the forward and aft end faces 150, 152 of the adjacent liner tiles 120 is particularly applicable in arrangements where restraint is desired in addition to the existing circumferential cable 126 retention. For example, the protrusion 166 and the slot 168 arrangement may be beneficial in managing the liner tile 120 expansion during elevated thermal cycles, by permitting a controlled degree of engagement and movement between the tiles, as appropriate for the material and loading of the combustor assembly.

The protrusion 166 on the aft end face 152 of the liner tile 120A and the corresponding slot 168 on the forward end face 150 of the liner tile 120B are illustrated as engaging over part of the liner tile 120 face height. In alternative embodiments, the length, width, and depth of the protrusion 166 and the slot 168 may be varied. For example, the protrusion 166 may engage the entire width of the liner tile 120, or a plurality of the protrusions 166 and the slots 168 may be included to provide multiple points of interlocking engagement. In other variants, the slot 168 may be configured as a groove with a curvilinear or non-uniform cross-section to match the corresponding protrusion 166 geometry.

In exemplary embodiments, it should be understood that similar geometric complementary interlocking features as shown in FIG. 12 may also be located on the first and second liner tile circumferential end faces 154, 156 of each liner tile 120, thereby creating interlocked assemblies along both the axial A and circumferential C directions. This may be beneficial for optimizing assembly robustness or for accommodating unique patterns of thermal or mechanical loading in particular combustor geometries.

Figure 13:
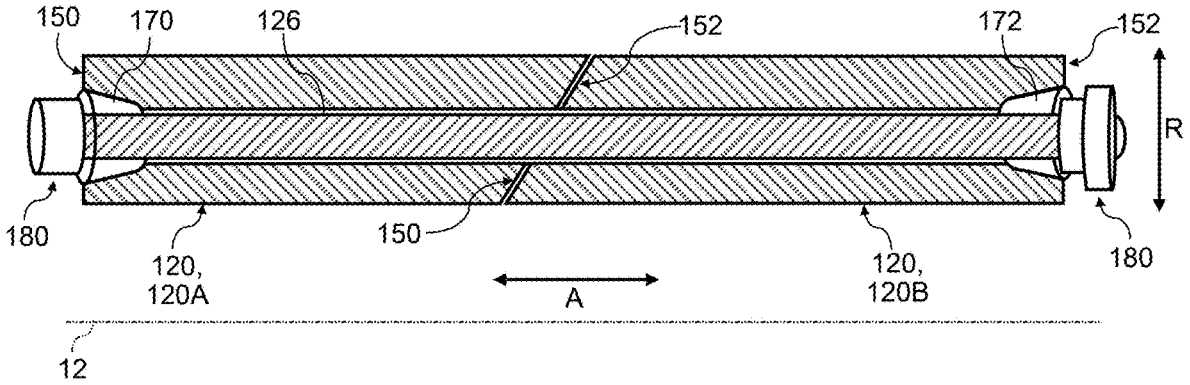
FIG. 13 is a schematic, section view of a portion of an exemplary combustor assembly in accordance with an exemplary embodiment of the present disclosure.

FIG. 13 is a schematic section, side view of a portion of the combustor assembly 80 in accordance with an exemplary aspect of the present disclosure. The exemplary combustor assembly 80 of FIG. 13 may be configured in substantially the same manner as the exemplary combustor assemblies described in connection with FIGS. 9-12, and accordingly, the same or similar numbers may refer to the same or similar parts. In the embodiment of FIG. 13, the liner tiles 120A, 120B are positioned adjacently in the axial direction A, with the cable 126 passing through each liner tile 120A, 120B in the axial direction A. The forward end face 150 and the aft end face 152 of the liner tiles 120A, 120B are formed at a non-orthogonal angle with respect to both the longitudinal axis 12 and the radial direction R. Additionally, FIG. 13 illustrates the locking elements 180 at oppositely located first and second ends 170, 172 of the cable 126, where each locking element 180 secures the cable 126 to the respective liner tile 120A, 120B and urges the liner tiles against each other at their axial end faces.

In greater detail, each liner tile 120 is shaped to define the forward end face 150 and the aft end face 152. These forward and aft end faces 150, 152 are oriented at an angle that is non-orthogonal with respect to the centerline (longitudinal axis 12) of the gas turbine engine 10 (FIG. 1) and also non-orthogonal to the radial direction R, as depicted. This angular configuration of the forward and aft end faces 150, 152 may improve the likelihood of distributing reaction forces along the joint between the adjacently positioned liner tiles 120A, 120B. Examples of non-orthogonal engagement angles include oblique cuts along the tile end faces, stepped surfaces, or chamfers, with the specific angle selected based on desired engagement and assembly requirements. In some alternative embodiments, the angle may be varied between different liner tile 120 rows or sections to account for variations in thermal expansion or mechanical stress distribution along the combustor liner 90.

The cable 126 and associated locking elements 180 may be installed with an optional pre-tension to bias the liner tiles 120A, 120B together along the angled joint. This preloading is not required but may be beneficial in certain applications to address vibration or differential displacement under high cycle operation. The number and arrangement of cables 126 in the axial direction may be varied according to liner tile 120 length, width, and the expected operational load on the combustor liner 90 segment. The angular configuration of the forward and aft end faces 150, 152 may, additionally or alternatively, be provided on the first and second liner tile circumferential end faces 154, 156 (FIG. 5).

The angular orientation of the liner tile forward end face 150 and aft end face 152, being non-orthogonal to the axial and radial directions, is of particular use where it is desirable for the engagement surface between liner tiles 120 to distribute forces across a larger area, improve sealing, or provide self-aligning features. For example, an angled or stepped interface may help reduce local stress concentrations or promote improved resistance to creeping apart under elevated engine temperatures.

In an alternative configuration, the cable 126 may extend through both liner tiles 120 without internal bores, instead being guided within surface channels or grooves. In such cases, localized clamps or similar surface-mounted locking elements may be provided. The use of angled joints remains applicable whether the cable 126 is internal or surface-routed.

Figure 14:
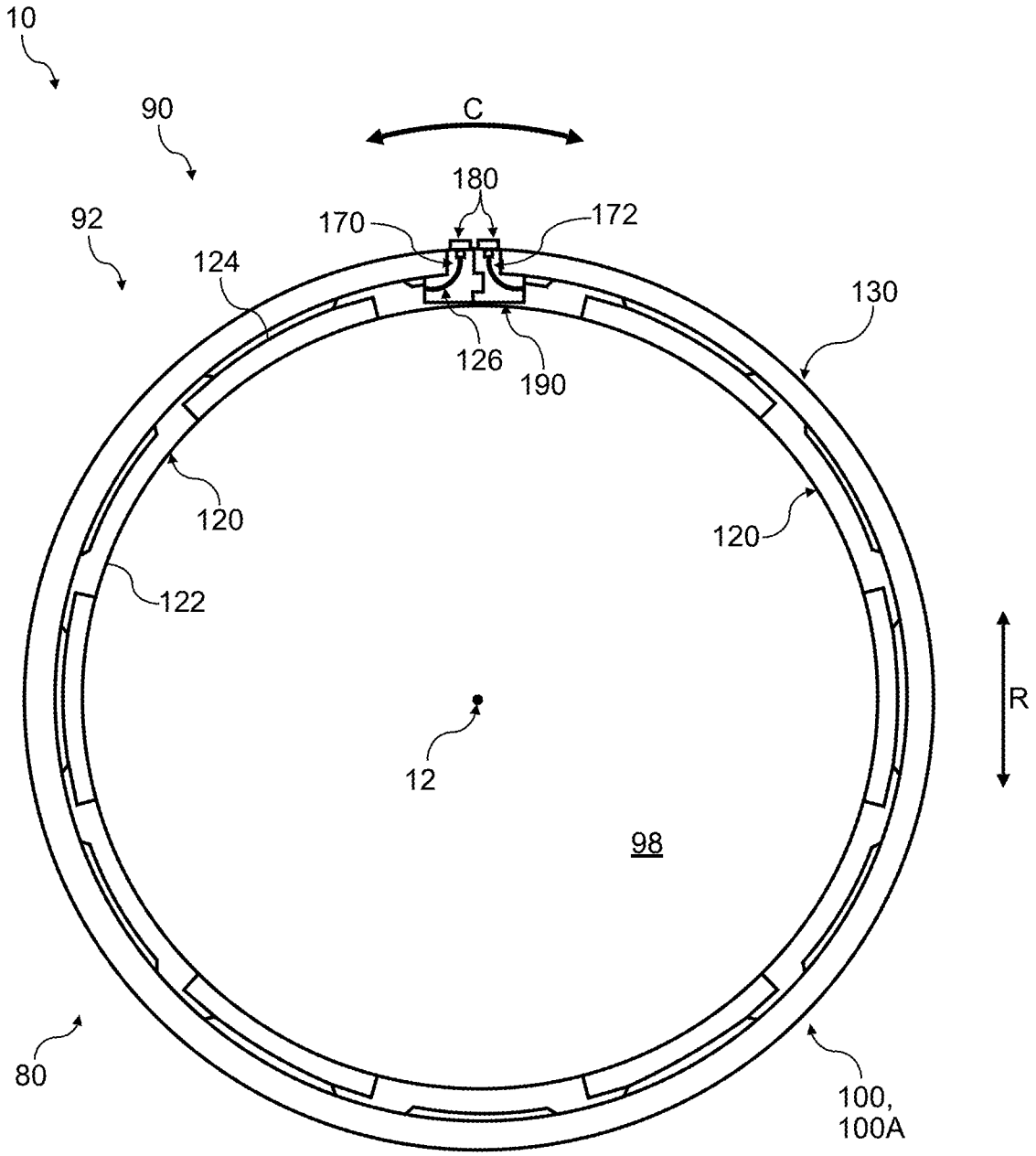
FIG. 14 is a schematic axial view of a portion of an exemplary combustor assembly in accordance with an exemplary embodiment of the present disclosure.

FIG. 14 is a schematic axial view of a portion of the combustor assembly 80 in accordance with an exemplary aspect of the present disclosure. The exemplary combustor assembly 80 of FIG. 14 may be configured in substantially the same manner as the embodiments previously described with respect to FIGS. 4-13, and accordingly, the same or similar numbers may refer to the same or similar parts. In the embodiment of FIG. 14, the cable 126 extends circumferentially through the liner tiles 120, with circumferentially opposed first and second ends 170, 172 of the cable 126 anchored to one or more cable tie mounting blocks 190 affixed to the combustor liner support shell 130. In the embodiment depicted in FIG. 14, the one or more cable tie mounting blocks 190 are located at a single circumferential location with respect to the combustor liner 90. Thus, in the embodiment illustrated in FIG. 14, the cable 126 extends circumferentially substantially 360 degrees about the annular combustor assembly 80. However, it should be understood that a plurality of cable tie mounting blocks 190 may be located at spaced apart circumferential locations, and the cable 126 may extend for partial circumferential spans. The arrangement further illustrates locking elements 180 retaining the respective first and second ends 170, 172 of the cable 126 at the one or more cable tile mounting block 190.

In greater detail, the combustor liner support assembly 100A in FIG. 14 includes the combustor liner support shell 130, which extends circumferentially about the central longitudinal axis 12. Disposed radially inward of the combustor liner support shell 130 is an array of the liner tiles 120. Each liner tile 120 is positioned so as to define a continuous boundary, extending circumferentially and forming at least a segment of the combustor liner 90. The liner tiles 120 are positioned adjacent one another along the circumferential direction C, and each liner tile 120 includes the liner tile inner surface 122, oriented toward the combustion chamber 98, and the tile outer surface 124, oriented radially outward toward the combustor liner support shell 130.

The cable 126 extends substantially 360 degrees in the circumferential direction through at least a portion of each of the liner tiles 120. The cable 126 may be routed through openings, channels, or passages defined in each liner tile 120 (e.g., such as the channel 160 depicted in FIG. 6). This configuration enables the cable 126 to secure each of the plurality of liner tiles 120 to the combustor liner support assembly 100A by passing through the full circumference of the liner tile 120 array.

Both the first end 170 and the second end 172 of the cable 126 are positioned at substantially the same circumferential location, as depicted at the upper region of FIG. 14. The cable 126 is secured to the combustor liner support assembly 100A at this location by engagement with one or more of the cable tie mounting blocks 190. The cable tie mounting blocks 190 are coupled to the combustor liner support shell 130 and extend radially inward toward the combustion chamber 98. In the embodiment shown, the cable tie mounting block 190 may also define at least a portion of the combustion chamber 98.

The cable tie mounting block 190 serves as an anchoring structure to which at least one of the first or second ends 170, 172 of the cable 126 may be affixed with locking elements 180. The locking elements 180 shown in FIG. 14 retain the first and second ends 170, 172 in place, thereby preventing the cable 126 from moving circumferentially relative to the combustor liner support shell 130. The locking elements 180 may be configured in a number of arrangements, for example as crimped ferrules, stake plates, or threaded retainers compatible with the materials and service environment of the combustor assembly 80. In illustrative embodiments, the locking elements 180 may be detachable, to facilitate service and replacement of the cable 126 or the liner tiles 120, or may be of a non-removable design for applications where permanent retention is preferred.

The configuration where both the first and second ends 170, 172 of the cable 126 terminate at substantially the same circumferential location is beneficial for installation and maintenance. For example, access to both the first and second ends 170, 172 of the cable 126 is localized, simplifying cable tensioning, removal, or replacement during service intervals. The location of the cable tie mounting block 190 may be selected based on combustor geometry or determined to align with regions of improved serviceability. The cable 126 may comprise any flexible, heat-resistant material, for example, a metallic cable or composite fiber element, and may be dimensioned to provide sufficient restraint for the mechanical and thermal environment of the combustor assembly 80 as a whole. The cable 126 may be configured as a pre-strained cable. In such cases, the cable 126 is installed under axial tension prior to locking the first and second ends 170, 172 with the locking elements 180, thereby urging the adjacent liner tiles 120 into close engagement along their circumferential faces. Pre-strain may be selected based on anticipated thermal expansion, mechanical loading, or desired retention force, but is considered an optional feature. It is further contemplated that multiple cables 126 may be installed in parallel, with each cable following a different circumferential path through independent or shared channels in the liner tiles 120. In such embodiments, each cable 126 may have its ends retained at the same or different cable tie mounting blocks 190, and the location and number of the cable tie mounting blocks 190 may be adjusted depending on combustor size, ease of access, or maintenance preference.

Figure 15:
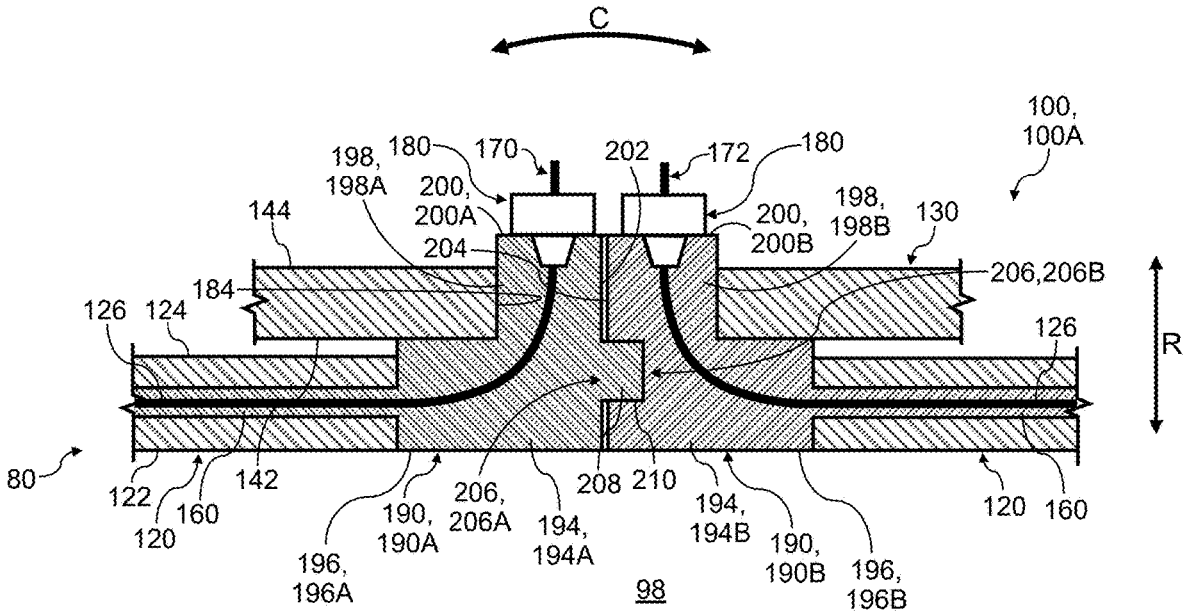
FIG. 15 is a schematic, section view of a portion of an exemplary combustor assembly in accordance with an exemplary embodiment of the present disclosure.

FIG. 15 is a schematic enlarged section view of a portion of the combustor assembly 80 in accordance with an exemplary aspect of the present disclosure. The exemplary combustor assembly 80 of FIG. 15 may be configured in substantially the same manner as the exemplary assemblies of FIGS. 4-14, and accordingly, the same or similar numbers may refer to the same or similar parts. In the embodiment of FIG. 15, a pair of cable tie mounting blocks 190A, 190B are coupled to the combustor liner support shell 130, with each cable tie mounting block 190A, 190B defining a cable tie mounting block inner surface 196 (identified as respective cable tie mounting block inner surfaces 196A, 196B in FIG. 15) facing radially inward toward the combustion chamber 98 and a cable tie mounting block outer surface 200 (identified as respective cable tie mounting block outer surfaces 200A, 200B in FIG. 15) facing radially outward. The cable 126 extends circumferentially through the liner tiles 120 with circumferentially opposed first and second ends 170, 172 of the cable 126 each routed radially outward through a respective cable tie mounting block 190A, 190B and secured at the cable tie mounting block outer surface 200A, 200B by a respective locking element 180. The cable tie mounting blocks 190A, 190B further include opposed interface elements 206, identified as respective interface elements 206A, 206B in FIG. 15, oriented toward each other in the circumferential direction C, with the interface elements 206A, 206B including geometric complementary locking features (e.g., a protrusion 208 and a slot 210).

As depicted in FIG. 15, the cable tie mounting block inner surfaces 196A, 196B define at least part of the combustion chamber 98. Each cable tie mounting block 190A, 190B includes a body 194, identified as respective bodies 194A, 194B in FIG. 15, extending from the combustor liner support shell 130 radially inward toward the combustion chamber 98. The body 194A of the cable tie mounting block 190A defines the cable tie mounting block inner surface 196A facing radially inward and the cable tie mounting block outer surface 200A facing radially outward, while the body 194B of the cable tie mounting block 190B defines the cable tie mounting block inner surface 196B and the cable tie mounting block outer surface 200B. The bodies 194A, 194B of the respective cable tie mounting block 190A, 190B define a cable tie mounting block extension element 198 (identified as respective cable tie mounting block extension elements 198A, 198B in FIG. 15) that extends through an aperture 184 defined in the combustor liner support shell 130 extending from a combustor liner support shell inner surface 142 of the combustor liner support shell 130 facing radially inward toward the combustion chamber 98 to a combustor liner support shell outer surface 144 opposite the combustor liner support shell inner surface 142 and facing radially outward away from the combustion chamber 98. In exemplary embodiments, each respective cable tie mounting block extension element 198A, 198B is formed as a unitary feature of a respective cable tie mounting block 190A, 190B, or may be attached by fasteners or bonding processes, depending on the required structural performance. At least a portion of each of the cable tie mounting block extension elements 198A, 198B may be seated against the combustor liner support shell inner surface 142.

The cable 126 defines the first end 170 and the second end 172, each extending through the respective cable tie mounting block 190A, 190B. In the embodiment of FIG. 15, the first end 170 of the cable 126 extends through the cable tie mounting block 190A and is secured radially outwardly at the cable tie mounting block outer surface 200A by one of the locking elements 180. Similarly, the second end 172 extends through the cable tie mounting block 190B and is secured at the cable tie mounting block outer surface 200B by one of the locking elements 180. In this way, each end of the cables 126 is anchored at a corresponding circumferential location to the combustor liner support shell 130. In selected embodiments, the cable 126 may be pre-strained during installation to improve the likelihood of maintaining inter-tile contact, though the pre-tensioning of the cable is not required in all assemblies.

The cable tie mounting block 190A defines a cable tie mounting block end face 202 oriented circumferentially toward a cable tie mounting block end face 204 defined by the cable tie mounting block 190B. The cable tie mounting block end faces 202, 204 serve as seating points for the adjacent cable tie mounting blocks 190A, 190B. The cable tie mounting block end faces 202, 204 each also define a cable tie mounting block interface element 206, identified as respective cable tie mounting block interface elements 206A and 206B in FIG. 15. The cable tie mounting block interface elements 206A and 206B are oriented in the circumferential direction C and include geometric complementary locking features to interlocking engage each other. In the embodiment illustrated in FIG. 15, the cable tie mounting block interface element 206A is a protrusion 208, and the cable tie mounting block interface element 206B is a slot 210. This arrangement may improve the positional stability of the cable tie mounting blocks 190A, 190B, restrict relative circumferential movement under load, or define a predetermined assembly orientation. In alternative embodiments, the cable tie mounting block interface elements 206A and 206B may be reversed (e.g., the slot 210 on the cable tie mounting block 190A, and the protrusion 208 on the cable tie mounting block 190B), or may be both provided as protrusions and slots on each cable tie mounting block 190A, 190B, depending on the degree of engagement or redundancy required.

By way of example, the geometric complementary locking features of the cable tie mounting block interface elements 206A, 206B may be formed as cylindrical pins and mating bores, dovetail profiles, or trapezoidal lands and grooves. The specific shape, length, and fit of the protrusion 208 and slot 210 may be tailored for ease of assembly, for serviceability, or to accommodate differential thermal expansion between the cable tie mounting blocks 190A, 190B and the combustor liner support shell 130.

The location of the first and second ends 170, 172 of the cable 126, as illustrated in FIG. 15, demonstrates that the cable 126 may extend circumferentially through the entire circumferential ring of the liner tiles 120, terminating at two distinct cable tie mounting blocks 190 circumferentially separated along the combustor liner support shell 130. The configuration of FIG. 15 is compatible with a combustor assembly 80 where multiple cables 126 are installed in parallel, each passing through a corresponding set of liner tiles 120, and with separate or shared attachment points at various cable tie mounting blocks 190 arranged circumferentially about the combustor liner support shell 130. For example, for combustor geometries requiring enhanced circumferential retention, additional sets of cables 126 and cable tie mounting blocks 190 may be employed at intervals selected to match the liner tile 120 count, thermal environment, or serviceability requirements.

Figure 16:
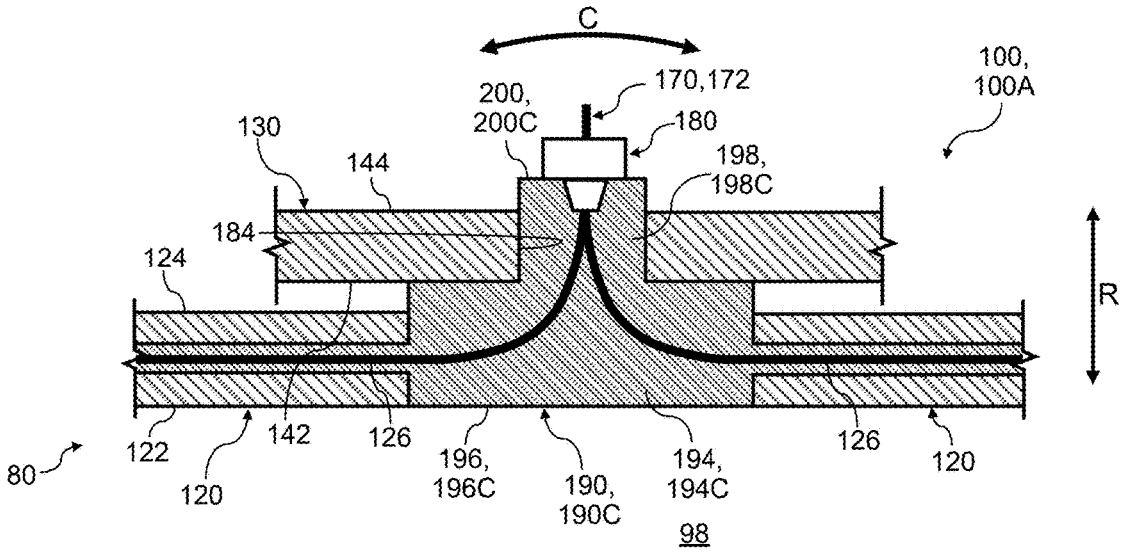
FIG. 16 is a schematic, section view of a portion of an exemplary combustor assembly in accordance with an exemplary embodiment of the present disclosure.

FIG. 16 is a schematic enlarged section view of a portion of the combustor assembly 80 in accordance with an exemplary aspect of the present disclosure. The exemplary combustor assembly 80 of FIG. 16 may be configured in substantially the same manner as the exemplary assemblies of FIGS. 4-15, and accordingly, the same or similar numbers may refer to the same or similar parts. In the embodiment of FIG. 16, the first and second ends 170, 172 of the cable 126 are coupled to a single cable tie mounting block 190C. Similar to the cable tie mounting blocks 190A, 190B, the cable tie mounting block 190C defines a body 194C defining a cable tie mounting block inner surface 196C extending radially inward and defining at least a portion of the combustion chamber 80, and a cable tie mounting block outer surface 200C facing radially outward. The body 194C also defines a cable tie mounting block extension element 198C extending radially outward through the aperture 184 defined by the combustor support shell 130.

The cable 126 extends through the liner tiles 120 and through the cable tie mounting block 190C. As the cable 126 passes through the cable tie mounting block 190C, the cable 126 transitions radially outward toward the cable tie mounting block outer surface 200C. The first and second ends 170, 172 of the cable 126 extend through the cable tie mounting block 190C and are together secured at the cable tie mounting block outer surface 200C by one of the locking elements 180. In this way, each end of the cable 126 is anchored at a same circumferential location to the combustor liner support shell 130. In selected embodiments, the cable 126 may be pre-strained during installation to improve the likelihood of maintaining inter-tile contact, though the pre-tensioning of the cable is not required in all assemblies.

Figure 17:
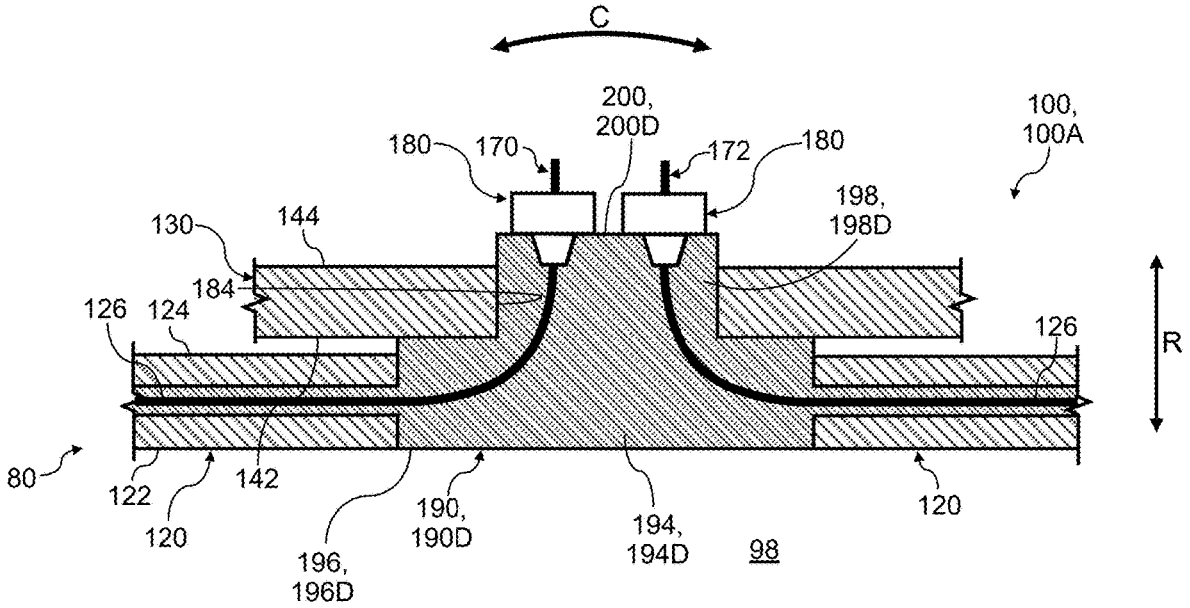
FIG. 17 is a schematic, section view of a portion of an exemplary combustor assembly in accordance with an exemplary embodiment of the present disclosure.

FIG. 17 is a schematic enlarged section view of a portion of the combustor assembly 80 in accordance with an exemplary aspect of the present disclosure. The exemplary combustor assembly 80 of FIG. 17 may be configured in substantially the same manner as the exemplary assemblies of FIGS. 4-16, and accordingly, the same or similar numbers may refer to the same or similar parts. In the embodiment of FIG. 17, the first and second ends 170, 172 of the cable 126 are coupled to a single cable tie mounting block 190D but by separate locking elements 180. Similar to the cable tie mounting blocks 190A-190C, the cable tie mounting block 190D defines a body 194D defining a cable tie mounting block inner surface 196D extending radially inward and defining at least a portion of the combustion chamber 80, and a cable tie mounting block outer surface 200D facing radially outward. The body 194D also defines a cable tie mounting block extension element 198D extending radially outward through the aperture 184 defined by the combustor support shell 130.

The cable 126 extends through the liner tiles 120 and through the cable tie mounting block 190D. As the cable 126 passes through the cable tie liner block 190D, the cable 126 transitions radially outward toward the cable tie mounting block outer surface 200D. The first and second ends 170, 172 of the cable 126 extend through the cable tie mounting block 190D and are independently secured at the cable tie mounting block outer surface 200D by respective locking elements 180. In this way, each end of the cable 126 is anchored at slightly different circumferential locations to the combustor liner support shell 130 but in close proximity to each other. In selected embodiments, the cable 126 may be pre-strained during installation to improve the likelihood of maintaining inter-tile contact, though the pre-tensioning of the cable is not required in all assemblies.

Figure 18:
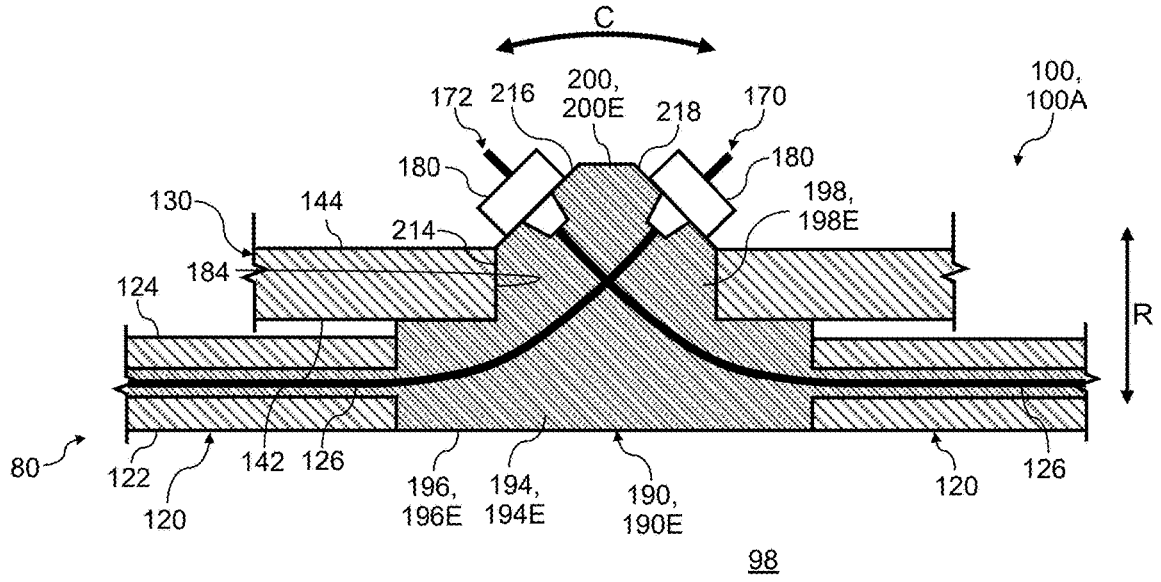
FIG. 18 is a schematic, section view of a portion of an exemplary combustor assembly in accordance with an exemplary embodiment of the present disclosure.

FIG. 18 is a schematic enlarged section view of a portion of the combustor assembly 80 in accordance with an exemplary aspect of the present disclosure. The exemplary combustor assembly 80 of FIG. 18 may be configured in substantially the same manner as the exemplary assemblies of FIGS. 4-17, and accordingly, the same or similar numbers may refer to the same or similar parts. In the embodiment of FIG. 18, the first and second ends 170, 172 of the cable 126 are coupled to a single cable tie mounting block 190E but at separate angled mounting surfaces.

Similar to the cable tie mounting blocks 190A-190D, the cable tie mounting block 190E defines a body 194E defining a cable tie mounting block inner surface 196E extending radially inward and defining at least a portion of the combustion chamber 80, and a cable tie mounting block outer surface 200E facing radially outward. The body 194E also defines a cable tie mounting block extension element 198E extending radially outward through the aperture 184 defined by the combustor support shell 130. The cable tie mounting block extension element 198E defines an extension element surface 214 abutting the surface of the aperture 184. In the exemplary embodiment depicted in FIG. 18, the body 194E also defines a first angled face 216 and a second angled face 218 facing radially outward at different angular orientations. The first and second angled faces 216, 218 are oriented at a substantially orthogonal angle to a direction of the cable 126 as the cable 126 exits a respective one of the first and second angled faces 216, 218. In other words, in exemplary embodiments, the first and second angled faces 216, 218 are oriented such that their normal vectors are substantially parallel to the direction of the cable 126 at their point of intersection.

As illustrated in FIG. 18, the cable 126 extends through the liner tiles 120 and through the cable tie mounting block 190E. As the cable 126 passes through the cable tie liner block 190E, the cable 126 transitions radially outward. The first end 170 of the cable 126 extends through the cable tie mounting block 190E and exits the cable tie mounting block 190E at the second angled face 218. The second end 172 of the cable 126 extends through the cable tie mounting block 190E and exits the cable tie mounting block 190E through the first angled face 216. Thus, the first and second ends 170, 172 are in a cross-over arrangement in the cable tie mounting block 190E with respect to each other. Each of the first and second ends 170, 172 of the cable 126 are independently secured at the respective second and first angles faces 218, 216 by respective locking elements 180. In this way, each end of the cable 126 is anchored at slightly different circumferential locations to the combustor liner support shell 130 but in close proximity to each other. Additionally, the first and second angled faces 216, 218 are oriented located such that they correspond orthogonally to an exit direction of the cable 126 from the cable tie mounting block 190E. Further, defining the first and second angled faces 216, 218 as set forth in the FIG. 18 arrangement enables a tension force to applied to the cable 126 substantially in-line with the direction the cable 126 is leaving the circumferential path through its last liner tile 120.

Figure 19:
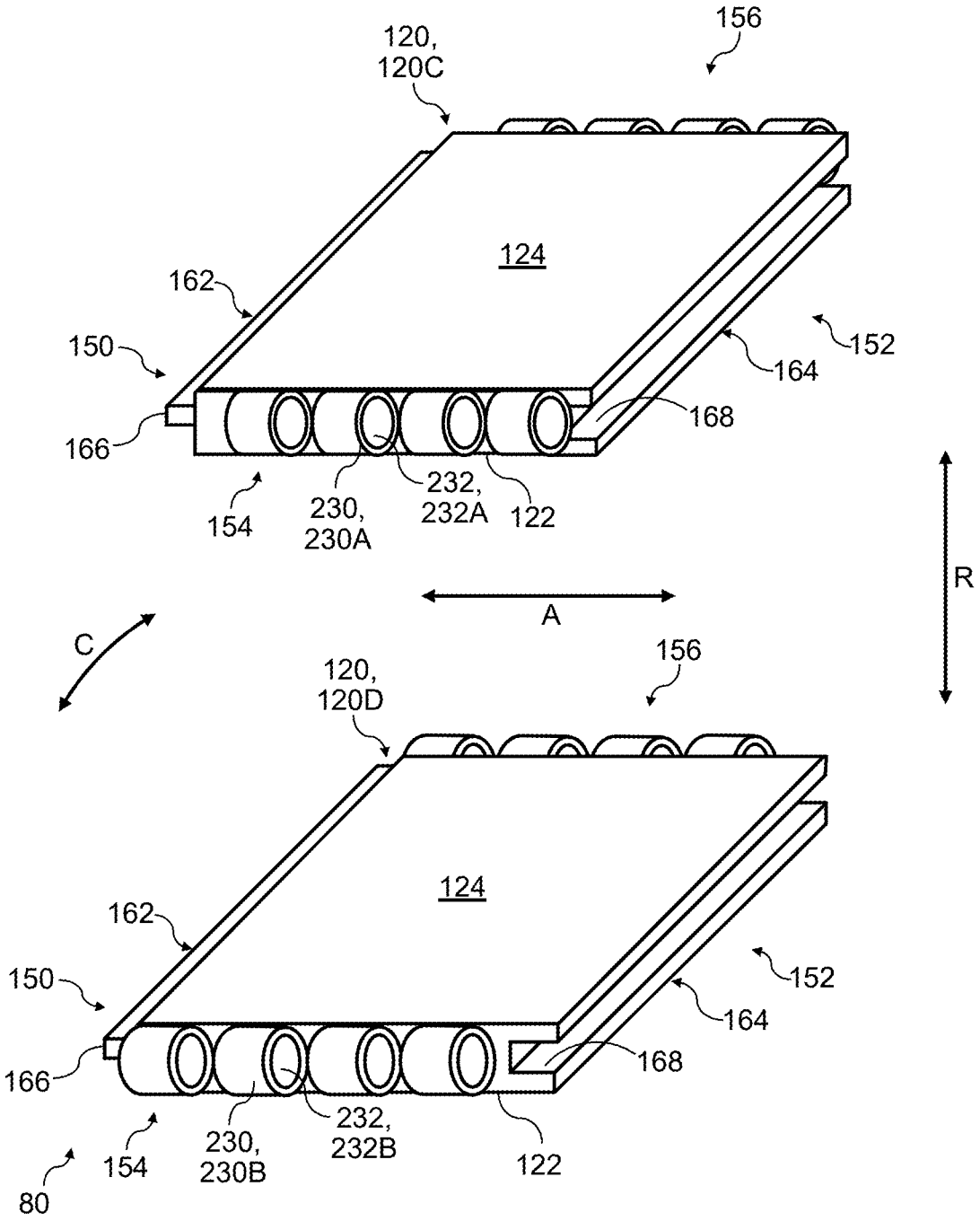
FIG. 19 is a schematic perspective view of a portion of an exemplary combustor assembly in accordance with an exemplary embodiment of the present disclosure.

FIG. 19 is a schematic perspective view of a portion of the combustor assembly 80 in accordance with an exemplary aspect of the present disclosure. The exemplary combustor assembly 80 of FIG. 19 may be configured in substantially the same manner as the exemplary assemblies of FIGS. 4-18, and accordingly, the same or similar numbers may refer to the same or similar parts. In the embodiment of FIG. 19, two of the liner tiles 120C and 120D are depicted in an unattached arrangement to better depict and describe various features of the liner tiles 120C, 120D. The liner tiles 120C, 120D may be configured similar to the liner tiles 120 described by earlier figures herein. By way of non-limiting example, each of the liner tiles 120C, 120D each include the liner tile inner surface 122, the liner tile outer surface 124, the liner tile forward and aft faces 150, 152, and first and second liner tile circumferential end faces 154, 156. In the embodiment illustrated in FIG. 19, the forward and aft liner tile faces 150, 152 include the respective interface elements 162, 164, in the form of the respective protrusion 166 and the slot 168 to interface with adjacent liner tiles 120 in the axial direction A.

In the embodiment illustrated in FIG. 19, the first and second liner tile circumferential end faces 154, 156 include a set of knuckles 230. In particular, the liner tile 120C includes a set of knuckles 230A, and the liner tile 120D includes the set of knuckles 230B. In the illustrated embodiment of FIG. 19, the liner tiles 120C, 120D each include four knuckles 230. However, it should be understood that the quantity of knuckles 230 on a particular liner tile 120 may be greater or fewer. In exemplary embodiments, the first and second liner tile circumferential end faces 154, 156 of the respective liner tiles 120C, 120D are coupled to each other in the circumferential direction C. By way of non-limiting example, the first liner tile circumferential end face 154 of the liner tile 120C will be positioned to engage with the second liner tile circumferential end face 156 of the liner tile 120D when mounted to the combustor liner support assembly 100A (FIG. 2). As such, the knuckles 230A formed on the liner tile 120C and axially offset with respect to the knuckles 230B formed on the liner tile 120D to enable the knuckles 230A, 230B to mesh with each other along an axial direction. In the illustrated embodiment of FIG. 19, the knuckles 230 each define a knuckle bore 232. In FIG. 19, the knuckles 230A each define a respective knuckle bore 232A, and the knuckles 230B each define a knuckle bore 232B. Accordingly, in exemplary embodiments, when the liner tiles 120C, 120D are positioned adjacent each other in the circumferential direction C as illustrated and described in previous figures, the knuckles 230A formed on the liner tile 120C mesh with the knuckles 230B formed on the liner tile 120D to coaxially align the knuckle bores 232A with the knuckle bores 232B.

Figure 20:
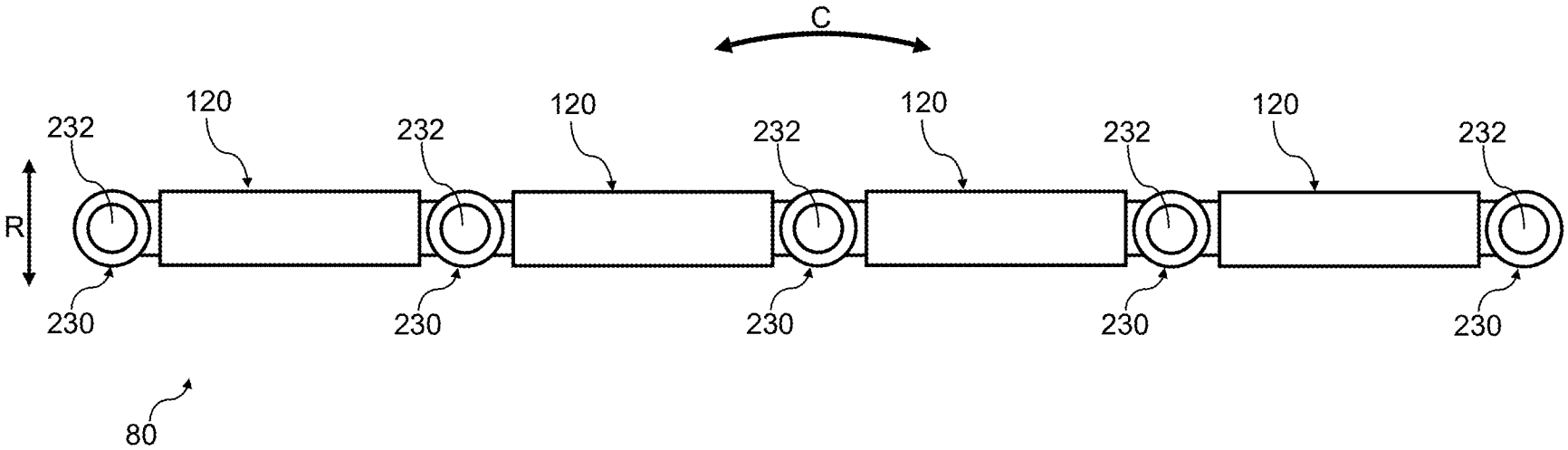
FIG. 20 is a schematic axial view of a portion of an exemplary combustor assembly in accordance with an exemplary embodiment of the present disclosure.

FIG. 20 is a schematic side view of a portion of the combustor assembly 80 in accordance with an exemplary aspect of the present disclosure. The exemplary combustor assembly 80 of FIG. 20 may be configured in substantially the same manner as the exemplary assemblies of FIGS. 4-19, and accordingly, the same or similar numbers may refer to the same or similar parts. In the embodiment of FIG. 20, a number of the liner tiles 120 are positioned adjacent each other in the circumferential direction C. The liner tiles 120 depicted in FIG. 20 are configured as respective ones of the liner tiles 120C, 120D depicted and described in connection with FIG. 19. For example, the liner tiles 120 are arranged such the knuckles 230 of each of the liner tiles 120 are in a meshed relationship with the knuckles 230 of an adjacent liner tile 120 such that the knuckle bores 232 of the respective liner tiles 120 are coaxially aligned in the axial direction A (e.g., in-and-out of the page in FIG. 20).

Figure 21:
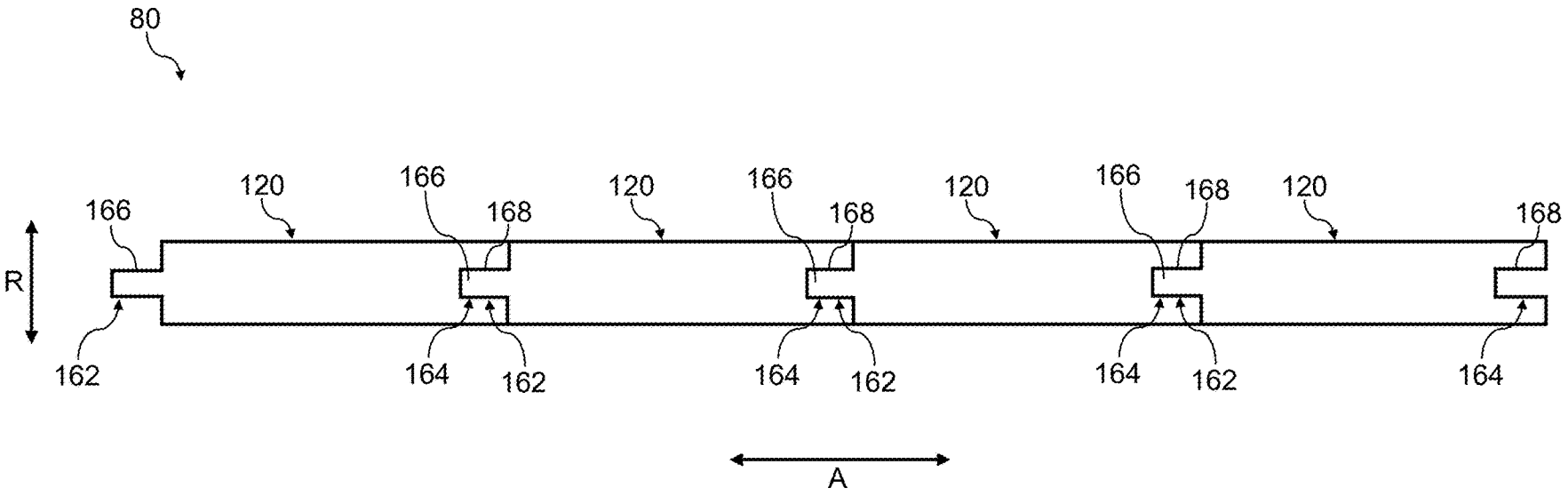
FIG. 21 is a schematic circumferential view of a portion of an exemplary combustor assembly in accordance with an exemplary embodiment of the present disclosure.

FIG. 21 is a schematic side view of a portion of the combustor assembly 80 in accordance with an exemplary aspect of the present disclosure. The exemplary combustor assembly 80 of FIG. 21 may be configured in substantially the same manner as the exemplary assemblies of FIGS. 4-20, and accordingly, the same or similar numbers may refer to the same or similar parts. In the embodiment of FIG. 21, a number of the liner tiles 120 are positioned adjacent each other in the axial direction A. The liner tiles 120 depicted in FIG. 21 are configured as respective ones of the liner tiles 120C, 120D depicted and described in connection with FIGS. 19 and 20. For example, the liner tiles 120 are arranged such the respective interface elements 162, 164, in the form of the protrusions 166 and the slots 168, are in a meshed or interlocking relationship with each other in the axial direction A.

Figure 22:
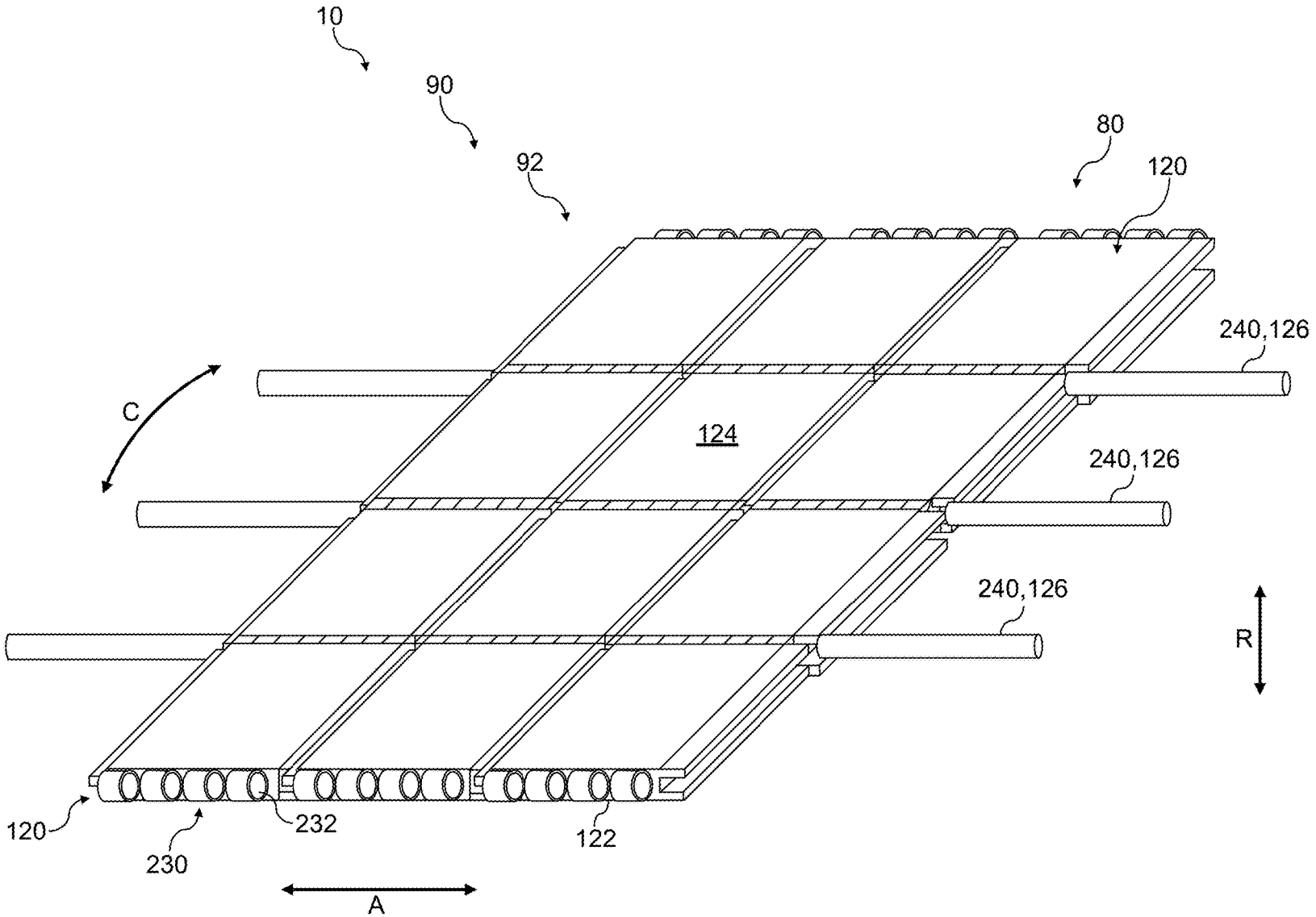
FIG. 22 is a schematic perspective view of a portion of an exemplary combustor assembly in accordance with an exemplary embodiment of the present disclosure.

FIG. 22 is a schematic, perspective view of a portion of the combustor assembly 80 in accordance with an exemplary aspect of the present disclosure. The exemplary combustor assembly 80 of FIG. 22 may be configured in substantially the same manner as the exemplary assemblies of FIGS. 4-21, and accordingly, the same or similar numbers may refer to the same or similar parts. In the embodiment of FIG. 22, a plurality of the liner tiles 120 are arrangement adjacent each other in the axial direction A and in the circumferential direction C. The liner tiles 120 depicted in FIG. 22 may be configured as illustrated and described in connection with FIGS. 19-21. As such, the liner tiles 120 are depicted with their respective knuckles 230 in a meshed arrangement with each other such that corresponding knuckle bores 232 are coaxially aligned. In the embodiment illustrated in FIG. 22, one or more pins 240 extend through the coaxially aligned knuckle bores 232 of adjacent liner tiles 120 to hingably couple and interlock the adjacent liner tiles 120 together in a hinge-like manner. In the embodiment illustrated in FIG. 22, the pins 240 extend in the axial direction through the coaxially aligned knuckle bores 232. It should be understood that the positioning or orientation the knuckles 230 and pins 240 may be reversed (e.g., extending in the circumferential direction) and/or extend in both the axial A and circumferential C directions. By way of non-limiting example, each of the end faces of the liner tiles 120 (e.g., forward, aft, and circumferential) may be formed with the knuckles 230 such that the hinge-like engagements of the liner tiles 120 extend in both the axial A and circumferential C directions.

The hinge-like engagement of the liner tiles 120 permits the liner tiles 120 to expand or contract independently in response to thermal cycling, when compared to rigid fasteners, since the knuckles 230 and pins 240 provide a flexible retaining arrangement for the liner tiles 120. The hinge-like engagement of the liner tiles 120 allows for controlled movement of each liner tile 120 within defined limits, thereby improving durability by reducing undesired thermally-induced stress concentrations at the liner tile joints. This configuration provides independent circumferential and axial restraint for different segments of each liner tile 120 and beneficially addresses the effects of thermal gradients along the liner tile 120 length.

It should be understood that embodiments of the liner tiles 120, cables 126, cable tie mounting blocks 190, geometric complementary interface elements 162, 164, knuckles 230, pins 240, etc., as set forth in FIGS. 4-22 may be combined in the combustor assembly 80. By way of non-limiting example, the hinge-like engagement of the liner tiles 120 as depicted in FIGS. 19-22 may be combined with the cable 126 arrangements depicted in any of FIGS. 4-18. Further, it should be understood that in exemplary embodiments, one or more of the cables 126 can extend through the coaxially aligned knuckle bores 232 of the adjacent liner tiles 120 to interlock the adjacent liner tiles 120 in a hinge-like manner. In such an exemplary embodiment, the pins 240 and the cables 126 can be used interchangeably or together in combination to provide the desired balance between liner tile 120 retention, thermal accommodation, manufacturability, and serviceability. By way of non-limiting example, in exemplary embodiments, the pins 240 may be used to connect the liner tiles 120 in the axial direction A, and the cables 126 may be used to connect the liner tiles 120 in the circumferential direction C. By way of another non-limiting example, the liner tiles 120 with the knuckles 230 may be coupled together using either the cables 126 or the pins 240, and the liner tiles 120 may be coupled to the combustor liner support shell 130 in a manner as depicted in FIG. 8 where the ends 170, 172 of the cable 126 are secured to the combustor liner support shell 130. By way of a further non-limiting example, the cable 126 could be connected to the cable tie mounting block 190 as depicted in the embodiments of FIGS. 15-18 (e.g., where the knuckles 230 extend in the circumferential direction C rather than in the axial direction A). Thus, it should be understood that the knuckles 230 may extend in the axial direction A or the circumferential direction C, and the interface elements 162, 164 may be arranged in the opposite direction. By way of another non-limiting example, the liner tiles 120 with the knuckles 230 may be coupled to the combustor liner support shell 130 via the pins 240 as depicted in the embodiment of FIG. 8 (e.g., the pins 240 extending through the knuckles 230 and through the first support shell radial flange 134 and the second support shell radial flange 136 of the combustor liner support shell 130 in addition or alternatively to the cable 126 as depicted in FIG. 8).

Thus, embodiments of the present disclosure provide a combustor assembly for a gas turbine engine including a plurality of liner tiles defining at least a portion of a combustor liner of a combustor of a gas turbine engine. The liner tiles may be metallic or non-metallic. Embodiments of the present disclosure arrange the liner tiles interlocked together in the axial and/or circumferential direction using a number of different techniques. In one exemplary embodiment, a cable is used to interlock the liner tiles to each other to define the combustor liner. In another exemplary embodiment, geometric complementary interlocking elements such as protrusions and grooves may be used to interlock the liner tiles in the axial and/or circumferential directions. In another exemplary embodiment of the present disclosure, a combination of knuckles and pins may be used to interlock the liner tiles using a hinge-like mechanism. One or more of the interlocking features of the present disclosure may be used in combination to interlock the liner tiles in the axial, radial, and/or circumferential directions. Embodiments of the present disclosure interlock the liner tiles in one or more arrangements that allow for thermal expansion and contraction of the liner tiles in response to thermal gradients and enable easier servicing of the liner tiles and/or combustion chamber 80.

Although specific features of various embodiments may be shown in some drawings and not in others, this is for convenience only. In accordance with the principles of the present disclosure, any feature of a drawing may be referenced and/or claimed in combination with any feature of any other drawing.

Further aspects of the disclosure are provided by the subject matter of the following clauses:

A combustor assembly for a gas turbine engine, the gas turbine engine defining an axial direction, the combustor assembly comprising: a combustor liner support assembly; and a plurality of liner tiles defining at least part of a combustion chamber, the combustion chamber extending between a forward end and an aft end generally along the axial direction with respect to the combustor liner support assembly; and a cable coupling at least one liner tile of the plurality of liner tiles to the combustor liner support assembly.

The combustor assembly of the preceding clause, wherein the cable extends through at least a portion of the at least one liner tile to secure the at least one liner tile to the combustor liner support assembly.

The combustor assembly of any preceding clause, wherein the at least one liner tile comprises a first liner tile and second liner tile positioned adjacent the first liner tile, and wherein the cable extends through at least a portion of the first liner tile and at least a portion of the second liner tile.

The combustor assembly of any preceding clause, wherein the gas turbine engine defines a circumferential direction, and wherein the first and second liner tiles are positioned adjacent each other in the circumferential direction.

The combustor assembly of any preceding clause, wherein the first and second liner tiles are positioned adjacent each other in the axial direction.

The combustor assembly of any preceding clause, wherein the at least one liner tile comprises a first liner tile and second liner tile positioned adjacent the first liner tile, wherein the first liner tile comprises an interface element that mechanically engages the second liner tile.

The combustor assembly of any preceding clause, wherein the at least one liner tile comprises a first liner tile and second liner tile positioned adjacent the first liner tile, wherein the first liner tile comprises a first interface element, and wherein the second liner tile comprises a second interface element, wherein the first and second interface elements comprise geometric complementary interlocking features.

The combustor assembly of any preceding clause, wherein the at least one liner tile comprises a first liner tile and second liner tile positioned adjacent the first liner tile, the first liner tile comprising a protrusion to interface with a slot defined on the second liner tile.

The combustor assembly of any preceding clause, wherein the at least one liner tile comprises a first liner tile and second liner tile positioned adjacent the first liner tile, the first liner tile defining a first liner tile end face to interface with a second liner end face defined on the second liner tile, the first liner tile end face and the second liner tile end face at an engagement angle non-orthogonal to a centerline of the gas turbine engine.

The combustor assembly of any preceding clause, wherein the gas turbine engine defines a circumferential direction, and wherein the cable comprises a first cable and a second cable, wherein the first cable extends in the axial direction to couple the at least one liner tile to the combustor liner support assembly, and wherein the second cable extends in the circumferential direction to couple the at least one liner tile to the combustor liner support assembly.

The combustor assembly of any preceding clause, wherein the first cable extends through at least a portion of the at least one liner tile in the axial direction, and wherein the second cable extends through at least another portion of the at least one liner tile in the circumferential direction.

The combustor assembly of any preceding clause, wherein the gas turbine engine defines a circumferential direction, and wherein the cable includes a first end and a second end opposite the first end, and wherein the cable extends circumferentially with respect to the combustion chamber where the first and second ends terminate substantially at a same circumferential location.

The combustor assembly of any preceding clause, wherein the combustor liner support assembly comprises: a combustor liner support shell; and a cable tie mounting block coupled to the combustor liner support shell and extending radially toward the combustion chamber, and wherein the cable is coupled to the cable tie mounting block.

The combustor assembly of any preceding clause, wherein the cable tie mounting block includes a first cable tie mounting block and a second cable tie mounting block, and wherein the first cable tie mounting block comprises a first interface element, and wherein the second cable tie mounting block comprises a second interface element, wherein the first and second interface elements comprise geometric complementary interlocking features.

The combustor assembly of any preceding clause, wherein the cable defines a first end and a second end opposite the first end, and wherein the first and second ends are coupled to the cable tie mounting block.

The combustor assembly of any preceding clause, wherein the cable tie mounting block includes a first cable tie mounting block and a second cable tie mounting block coupled to the first cable tie mounting block, and wherein the cable defines a first end and a second end opposite the first end, and wherein the first end of the cable is coupled to the first cable tie mounting block, and the second end of the cable is coupled to the second cable tie mounting block.

The combustor assembly of any preceding clause, wherein the at least one liner tile comprises an internal channel, and wherein the cable extends through the channel.

The combustor assembly of any preceding clause, wherein the at least one liner tile defines a first internal channel and a second internal channel spaced apart from the first internal channel, and wherein the cable comprises a first cable extending through the first channel and a second cable extending through the second channel.

The combustor assembly of any preceding clause, wherein the at least one liner tile comprises a first liner tile and second liner tile positioned adjacent the first liner tile, wherein the first liner tile defines one or more first knuckles, and wherein the second liner tile defines one or more second knuckles, and wherein the first knuckles are coupled to the second knuckles to hingably couple the first liner tile to the second liner tile.

The combustor assembly of any preceding clause, wherein the cable or a pin extends through the one or more first knuckles and the one or more second knuckles to hingably couple the first liner tile to the second liner tile.

The combustor assembly of any preceding clause, wherein the gas turbine engine defines a circumferential direction, and wherein the cable extends in the circumferential direction.

The combustor assembly of any preceding clause, wherein the cable extends in the axial direction.

The combustor assembly of any preceding clause, wherein the gas turbine engine defines a circumferential direction, and wherein the cable extends substantially 360 degrees in the circumferential direction.

A combustor assembly for a gas turbine engine, the gas turbine engine defining an axial direction, the combustor assembly comprising: a combustor liner support assembly; and a plurality of liner tiles coupled to the combustor liner support assembly and defining at least part of a combustion chamber, the combustion chamber extending between a forward end and an aft end generally along the axial direction with respect to the combustor liner support assembly, and wherein a first liner tile of the plurality of liner tiles defines one or more first knuckles, and wherein a second liner tile of the plurality of liner tiles defines one or more second knuckles; and a pin or a cable extending through the one or more first knuckles and the one or more second knuckles to mechanically engage the first liner tile to the second liner tile.

The combustor assembly of any preceding clause, wherein the pin or the cable extends in the axial direction.

The combustor assembly of any preceding clause, wherein the first liner tile comprises an interface element to mechanically engage a third liner tile positioned adjacent the first liner tile in the axial direction.

A gas turbine engine defining an axial direction and a circumferential direction, the gas turbine engine comprising: a fan section comprising a fan; and a turbomachine drivably coupled to the fan, the turbomachine comprising a compressor section, a combustion section, and a turbine section in serial flow order, the combustion section comprising: a combustor liner support assembly; a plurality of liner tiles defining at least part of a combustion chamber, the combustion chamber extending between a forward end and an aft end generally along the axial direction with respect to the combustor liner support assembly; and a cable coupling at least one liner tile of the plurality of liner tiles to the combustor liner support assembly.

The gas turbine engine of any preceding clause, wherein the cable extends in the circumferential direction.

The gas turbine engine of any preceding clause, wherein the cable extends through at least a portion of the at least one liner tile.

The gas turbine engine of any preceding clause, wherein the at least one liner tile comprises a first liner tile and second liner tile positioned adjacent the first liner tile, and wherein the cable extends through at least a portion of the first liner tile and at least a portion of the second liner tile.

The gas turbine engine of any preceding clause, wherein the gas turbine engine defines a circumferential direction, and wherein the first and second liner tiles are positioned adjacent each other in the circumferential direction.

The gas turbine engine of any preceding clause, wherein the first and second liner tiles are positioned adjacent each other in the axial direction.

The gas turbine engine of any preceding clause, wherein the at least one liner tile comprises a first liner tile and second liner tile positioned adjacent the first liner tile, wherein the first liner tile comprises an interface element that mechanically engages the second liner tile.

The gas turbine engine of any preceding clause, wherein the at least one liner tile comprises a first liner tile and second liner tile positioned adjacent the first liner tile, wherein the first liner tile comprises a first interface element, and wherein the second liner tile comprises a second interface element, wherein the first and second interface elements comprise geometric complementary interlocking features.

The gas turbine engine of any preceding clause, wherein the at least one liner tile comprises a first liner tile and second liner tile positioned adjacent the first liner tile, the first liner tile comprising a protrusion to interface with a slot defined on the second liner tile.

The gas turbine engine of any preceding clause, wherein the at least one liner tile comprises a first liner tile and second liner tile positioned adjacent the first liner tile, the first liner tile defining a first liner tile end face to interface with a second liner end face defined on the second liner tile, the first liner tile end face and the second liner tile end face at an engagement angle non-orthogonal to a centerline of the gas turbine engine.

The gas turbine engine of any preceding clause, wherein the gas turbine engine defines a circumferential direction, and wherein the cable comprises a first cable and a second cable, wherein the first cable extends in the axial direction to couple the at least one liner tile to the combustor liner support assembly, and wherein the second cable extends in the circumferential direction to couple the at least one liner tile to the combustor liner support assembly.

The gas turbine engine of any preceding clause, wherein the first cable extends through at least a portion of the at least one liner tile in the axial direction, and wherein the second cable extends through at least another portion of the at least one liner tile in the circumferential direction.

The gas turbine engine of any preceding clause, wherein the gas turbine engine defines a circumferential direction, and wherein the cable includes a first end and a second end opposite the first end, and wherein the cable extends circumferentially with respect to the combustion chamber where the first and second ends terminate substantially at a same circumferential location.

The gas turbine engine of any preceding clause, wherein the combustor liner support assembly comprises: a combustor liner support shell; and a cable tie mounting block coupled to the combustor liner support shell and extending radially toward the combustion chamber, and wherein the cable is coupled to the cable tie mounting block.

The gas turbine engine of any preceding clause, wherein the cable tie mounting block includes a first cable tie mounting block and a second cable tie mounting block, and wherein the first cable tie mounting block comprises a first interface element, and wherein the second cable tie mounting block comprises a second interface element, wherein the first and second interface elements comprise geometric complementary interlocking features.

The gas turbine engine of any preceding clause, wherein the cable defines a first end and a second end opposite the first end, and wherein the first and second ends are coupled to the cable tie mounting block.

The gas turbine engine of any preceding clause, wherein the cable tie mounting block includes a first cable tie mounting block and a second cable tie mounting block coupled to the first cable tie mounting block, and wherein the cable defines a first end and a second end opposite the first end, and wherein the first end of the cable is coupled to the first cable tie mounting block, and the second end of the cable is coupled to the second cable tie mounting block.

The gas turbine engine of any preceding clause, wherein the at least one liner tile comprises a first liner tile and second liner tile positioned adjacent the first liner tile, wherein the first liner tile defines one or more first knuckles, and wherein the second liner tile defines one or more second knuckles, and wherein the first knuckles are coupled to the second knuckles to hingably couple the first liner tile to the second liner tile.

The gas turbine engine of any preceding clause, wherein the cable or a pin extends through the one or more first knuckles and the one or more second knuckles to hingably couple the first liner tile to the second liner tile.

The gas turbine engine of any preceding clause, wherein the gas turbine engine defines a circumferential direction, and wherein the cable extends in the circumferential direction.

The gas turbine engine of any preceding clause, wherein the cable extends in the axial direction.

The gas turbine engine of any preceding clause, wherein the gas turbine engine defines a circumferential direction, and wherein the cable extends substantially 360 degrees in the circumferential direction.

A combustor assembly for a gas turbine engine, the gas turbine engine defining an axial direction, the combustor assembly comprising: a combustor liner support assembly comprising a cable tie mounting block; a plurality of liner tiles defining at least part of a combustion chamber, the combustion chamber extending between a forward end and an aft end generally along the axial direction with respect to the combustor liner support assembly; and a cable securing at least one liner tile of the plurality of liner tiles to the cable tie mounting block.

The combustor assembly of any preceding clause, wherein the cable extends through at least a portion of the at least one liner tile.

The combustor assembly of any preceding clause, wherein the gas turbine engine defines a circumferential direction, and wherein the cable tie mounting block is located at a single circumferential location.

The combustor assembly of any preceding clause, wherein the cable defines a first end and a second end opposite the first end, and wherein the first and second ends are coupled to the cable tie mounting block.

The combustor assembly of any preceding clause, wherein the cable defines a first end and a second end opposite the first end, and wherein at least one of the first end or the second end is coupled to the cable tie mounting block.

The combustor assembly of any preceding clause, wherein the cable tie mounting block includes a first cable tie mounting block and a second cable tie mounting block, and wherein the cable defines a first end and a second end opposite the first end, and wherein the first end is coupled to the first cable tie mounting block, and the second end is coupled to the second cable tie mounting block.

A combustor assembly for a gas turbine engine, the gas turbine engine defining an axial direction and a circumferential direction, the combustor assembly comprising: a combustor liner support assembly; a plurality of liner tiles extending in the circumferential direction and defining at least part of an axial segment of a combustion chamber, the combustion chamber extending between a forward end and an aft end generally along the axial direction with respect to the combustor liner support assembly; and a cable extending substantially 360 degrees in the circumferential direction securing the plurality of liner tiles to the combustor liner support assembly.

The combustor assembly of any preceding clause, wherein the cable is a pre-strained cable.

The combustor assembly of any preceding clause, wherein at least one liner tile of the plurality of liner tiles defines a channel, and wherein the cable extends through the channel.

The combustor assembly of any preceding clause, wherein the channel comprises an internal channel.

The combustor assembly of any preceding clause, wherein the at least one liner tile defines a first circumferential end face and a second circumferential end face opposite the first circumferential end face, and wherein the internal channel extends circumferentially from the first circumferential end face to the second circumferential end face.

The combustor assembly of any preceding clause, wherein the cable includes a first cable and a second cable, and wherein the first and second cables extend through the channel spaced apart from each other in the axial direction.

The combustor assembly of any preceding clause, wherein the plurality of liner tiles includes a first liner tile and a second liner tile, wherein the first liner tile defines a liner tile inner surface facing the combustion chamber.

A combustor assembly for a gas turbine engine, the gas turbine engine defining an axial direction, the combustor assembly comprising: a combustor liner support assembly; a plurality of liner tiles defining at least part of a combustion chamber, the combustion chamber extending between a forward end and an aft end generally along the axial direction with respect to the combustor liner support assembly; and a cable defining a first end and a second end opposite the first end, wherein the cable extends through at least a portion of the plurality of liner tiles, wherein the first end of the cable is secured to the combustor liner support assembly at a first location, and wherein the second end of the cable is secured to the combustor liner support assembly at a second location spaced apart from the first location.

The combustor assembly of any preceding clause, wherein the cable extends through at least a portion of the plurality of liner tiles.

The combustor assembly of any preceding clause, wherein the gas turbine engine defines a circumferential direction, and wherein the first location is spaced apart from the second location in the circumferential direction.

The combustor assembly of any preceding clause, wherein the plurality of liner tiles includes a first liner tile and a second liner tile positioned adjacent the first liner tile, and wherein the cable urges the first liner tile against the second liner tile.

A combustor assembly for a gas turbine engine, the gas turbine engine defining an axial direction and comprising a combustor defining a combustion chamber extending between a forward end and an aft end generally along the axial direction, the combustor assembly comprising: a plurality of liner tiles defining at least part of the combustion chamber, the plurality of liner tiles comprising: a first liner tile defining one or more first knuckles; and a second liner tile defining one or more second knuckles, and wherein the one or more first knuckles are hingably coupled to the one or more second knuckles to mechanically interlock the first liner tile to the second liner tile.

The combustor assembly of any preceding clause, wherein the one or more first knuckles define one or more first knuckle bores, and wherein the one or more second knuckles define one or more second knuckle bores, and wherein the one or more first knuckle bores are coaxially aligned with the one or more second knuckle bores.

The combustor assembly of any preceding clause, wherein a pin or a cable extends through the one or more first knuckle bores and the one or more second knuckle bores.

The combustor assembly of any preceding clause, wherein the pin or the cable extends in the axial direction.

The combustor assembly of any preceding clause, wherein a cable extends through the one or more first knuckle bores and the one or more second knuckle bores.

The combustor assembly of any preceding clause, wherein a pin or a cable extends through the one or more first knuckles and the one or more second knuckles to mechanically engage the first liner tile to the second liner tile.

The combustor assembly of any preceding clause, wherein the one or more first knuckles are located on a circumferential end face of the first liner tile.

The combustor assembly of any preceding clause, wherein the one or more second knuckles are located on a circumferential end face of the second liner tile.

The combustor assembly of any preceding clause, wherein the one or more first knuckles are offset with respect to the one or more second knuckles.

The combustor assembly of any preceding clause, wherein the one or more first knuckles are axially offset with respect to the one or more second knuckles.

The combustor assembly of any preceding clause, wherein the first liner comprises a first end face and a second end face opposite the first end face, and wherein the first end face comprises a protrusion, and wherein the second end face comprises a slot.

The combustor assembly of any preceding clause, wherein the plurality of liner tiles comprises a third liner tile, and wherein the first liner tile comprises a protrusion, and wherein the third liner tile comprises a slot configured to receive the protrusion.

The combustor assembly of any preceding clause, wherein the plurality of liner tiles comprises a third liner tile, and wherein the third liner tile comprises a protrusion, and wherein the first liner tile comprises a slot configured to receive the protrusion.

The combustor assembly of any preceding clause, wherein the first liner tile comprises a first end face and a second end face opposite the first end face, and wherein the first and second end faces each comprises an interface element having a geometric interlocking feature.

The combustor assembly of any preceding clause, wherein a pin extends through the one or more first knuckle and the one or more second knuckles, and wherein the pin is coupled to the combustor liner support assembly.

The combustor assembly of any preceding clause, wherein the combustor liner support assembly comprises combustor liner support shell defining at least one support shell radial flange, and wherein the pin extends through the at least one support shell radial flange.

The combustor assembly of any preceding clause, wherein the plurality of liner tiles comprises a third liner tile, and wherein the first liner tile defines a first liner tile end face to interface with a second liner tile end face defined on the third liner tile, the first liner tile end face and the second liner tile end face at an engagement angle non-orthogonal to a centerline of the gas turbine engine.

The combustor assembly of any preceding clause, wherein the first liner tile defines a first liner tile end face and a second liner tile end face opposite the first liner tile end face, and wherein the one or more first knuckles are defined on the first liner tile end face, and wherein the second liner tile end face defines one or more third knuckles.

A combustor assembly for a gas turbine engine, the gas turbine engine defining an axial direction, the combustor assembly comprising: a combustor liner support assembly; and a plurality of liner tiles coupled to the combustor liner support assembly and defining at least part of a combustion chamber, the combustion chamber extending between a forward end and an aft end generally along the axial direction with respect to the combustor liner support assembly, wherein the plurality of liner tiles comprises a first liner tile and a second liner tile, wherein the first liner tile defines a first liner tile end face, and wherein the second liner tile defines a second liner tile end face, and wherein the first liner tile end face is hingably coupled to the second liner tile end face.

The combustor assembly of any preceding clause, wherein the gas turbine engine defines a circumferential direction, and wherein first and second liner tile end faces comprises circumferential end faces.

The combustor assembly of any preceding clause, wherein the first liner tile end face comprises a plurality of first knuckles configured to mesh with a plurality of second knuckles defined on the second liner tile end face.

The combustor assembly of any preceding clause, wherein first and second liner tile end faces comprises respective forward and aft end faces.

The combustor assembly of any preceding clause, wherein the first liner tile defines a third liner tile end face, the third liner tile end face comprising a geometric interlocking feature.

A gas turbine engine defining an axial direction and a circumferential direction, the gas turbine engine comprising: a fan section comprising a fan; and a turbomachine drivably coupled to the fan, the turbomachine comprising a compressor section, a combustion section, and a turbine section in serial flow order, the combustion section comprising: a combustor liner support assembly; and a plurality of liner tiles coupled to the combustor liner support assembly and defining at least part of a combustion chamber, the combustion chamber extending between a forward end and an aft end generally along the axial direction with respect to the combustor liner support assembly, and wherein a first liner tile of the plurality of liner tiles defines one or more first knuckles, and wherein a second liner tile of the plurality of liner tiles defines one or more second knuckles, and wherein the one or more first knuckles are hingably coupled to the one or more second knuckles to mechanically interlock the first liner tile to the second liner tile.

The gas turbine engine of any preceding clause, wherein the one or more first knuckles define one or more first knuckle bores, and wherein the one or more second knuckles define one or more second knuckle bores, and wherein the one or more first knuckle bores are coaxially aligned with the one or more second knuckle bores.

The gas turbine engine of any preceding clause, wherein a pin extends through the one or more first knuckle bores and the one or more second knuckle bores.

The gas turbine engine of any preceding clause, wherein a cable extends through the one or more first knuckle bores and the one or more second knuckle bores.

The gas turbine engine of any preceding clause, wherein a pin or a cable extends through the one or more first knuckles and the one or more second knuckles to mechanically engage the first liner tile to the second liner tile.

The gas turbine engine of any preceding clause, wherein the first knuckles are located on a circumferential end face of the first liner tile.

The gas turbine engine of any preceding clause, wherein the second knuckles are located on a circumferential end face of the second liner tile.

The gas turbine engine of any preceding clause, wherein the one or more first knuckles are offset with respect to the one or more second knuckles.

The gas turbine engine of any preceding clause, wherein the first knuckles are axially offset with respect to the second knuckles.

The gas turbine engine of any preceding clause, wherein one of the first liner tile or the second liner tile comprises a protrusion, and wherein the other of the first liner tile or the second liner tile comprises a slot configured to receive the protrusion.

A gas turbine engine defining an axial direction and a circumferential direction, the gas turbine engine comprising: a fan section comprising a fan; and a turbomachine drivably coupled to the fan, the turbomachine comprising a compressor section, a combustion section, and a turbine section in serial flow order, the combustion section comprising: a combustor liner support assembly comprising a cable tie mounting block; a plurality of liner tiles defining at least part of a combustion chamber, the combustion chamber extending between a forward end and an aft end generally along the axial direction with respect to the combustor liner support assembly; and a cable securing at least one liner tile of the plurality of liner tiles to the cable tie mounting block.

A gas turbine engine defining an axial direction and a circumferential direction, the gas turbine engine comprising: a fan section comprising a fan; and a turbomachine drivably coupled to the fan, the turbomachine comprising a compressor section, a combustion section, and a turbine section in serial flow order, the combustion section comprising: a combustor liner support assembly; a plurality of liner tiles extending in the circumferential direction and defining at least part of an axial segment of a combustion chamber, the combustion chamber extending between a forward end and an aft end generally along the axial direction with respect to the combustor liner support assembly; and a cable extending substantially 360 degrees in the circumferential direction securing the plurality of liner tiles to the combustor liner support assembly.

A gas turbine engine defining an axial direction and a circumferential direction, the gas turbine engine comprising: a fan section comprising a fan; and a turbomachine drivably coupled to the fan, the turbomachine comprising a compressor section, a combustion section, and a turbine section in serial flow order, the combustion section comprising: a combustor liner support assembly; a plurality of liner tiles defining at least part of a combustion chamber, the combustion chamber extending between a forward end and an aft end generally along the axial direction with respect to the combustor liner support assembly; and a cable defining a first end and a second end opposite the first end, wherein the cable extends through at least a portion of the plurality of liner tiles, wherein the first end of the cable is secured to the combustor liner support assembly at a first location, and wherein the second end of the cable is secured to the combustor liner support assembly at a second location spaced apart from the first location.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine, the gas turbine engine defining an axial direction, the combustor assembly comprising:

a combustor liner support assembly; and a plurality of liner tiles coupled to the combustor liner support assembly and defining at least part of a combustion chamber, the combustion chamber extending between a forward end and an aft end generally along the axial direction with respect to the combustor liner support assembly, and wherein a first liner tile of the plurality of liner tiles defines one or more first knuckles, and wherein a second liner tile of the plurality of liner tiles defines one or more second knuckles, and wherein the one or more first knuckles are in meshed hingable engagement with the one or more second knuckles to mechanically interlock the first liner tile to the second liner tile.

2. The combustor assembly of claim 1, wherein the one or more first knuckles define one or more first knuckle bores, and wherein the one or more second knuckles define one or more second knuckle bores, and wherein the one or more first knuckle bores are coaxially aligned with the one or more second knuckle bores.

3. The combustor assembly of claim 2, wherein a pin or a cable extends through the one or more first knuckle bores and the one or more second knuckle bores.

4. The combustor assembly of claim 3, wherein the pin or the cable extends in the axial direction.

5. The combustor assembly of claim 1, wherein the one or more first knuckles are located on a circumferential end face of the first liner tile.

6. The combustor assembly of claim 5, wherein the one or more second knuckles are located on a circumferential end face of the second liner tile.

7. The combustor assembly of claim 1, wherein the one or more first knuckles are offset with respect to the one or more second knuckles.

8. The combustor assembly of claim 1, wherein the plurality of liner tiles comprises a third liner tile, and wherein the first liner tile comprises a protrusion, and wherein the third liner tile comprises a slot configured to receive the protrusion.

9. The combustor assembly of claim 1, wherein the first liner tile comprises a first end face and a second end face opposite the first end face, and wherein the first end face comprises a protrusion, and wherein the second end face comprises a slot.

10. The combustor assembly of claim 1, wherein the plurality of liner tiles comprises a third liner tile, and wherein the third liner tile comprises a protrusion, and wherein the first liner tile comprises a slot configured to receive the protrusion.

11. The combustor assembly of claim 1, wherein the first liner tile comprises a first end face and a second end face opposite the first end face, and wherein the first and second end faces each comprises an interface element having a geometric interlocking feature.

12. The combustor assembly of claim 1, wherein a pin extends through the one or more first knuckles and the one or more second knuckles, and wherein the pin is coupled to the combustor liner support assembly.

13. The combustor assembly of claim 12, wherein the combustor liner support assembly comprises combustor liner support shell defining at least one support shell radial flange, and wherein the pin extends through the at least one support shell radial flange.

14. The combustor assembly of claim 1, wherein the plurality of liner tiles comprises a third liner tile, and wherein the first liner tile defines a first liner tile end face to interface with a second liner tile end face defined on the third liner tile, the first liner tile end face and the second liner tile end face at an engagement angle non-orthogonal to a centerline of the gas turbine engine.

15. The combustor assembly of claim 1, wherein the first liner tile defines a first liner tile end face and a second liner tile end face opposite the first liner tile end face, and wherein the one or more first knuckles are defined on the first liner tile end face, and wherein the second liner tile end face defines one or more third knuckles.

16. A combustor assembly for a gas turbine engine, the gas turbine engine defining an axial direction, the combustor assembly comprising:

a combustor liner support assembly; and a plurality of liner tiles coupled to the combustor liner support assembly and defining at least part of a combustion chamber, the combustion chamber extending between a forward end and an aft end generally along the axial direction with respect to the combustor liner support assembly, wherein the plurality of liner tiles comprises a first liner tile and a second liner tile, wherein the first liner tile defines a first liner tile end face, and wherein the second liner tile defines a second liner tile end face, and wherein the first liner tile end face is hingably coupled to the second liner tile end face.

17. The combustor assembly of claim 16, wherein the gas turbine engine defines a circumferential direction, and wherein first and second liner tile end faces comprises circumferential end faces.

18. The combustor assembly of claim 16, wherein the first liner tile end face comprises a plurality of first knuckles configured to mesh with a plurality of second knuckles defined on the second liner tile end face.

19. The combustor assembly of claim 16, wherein first and second liner tile end faces comprises respective forward and aft end faces.

20. The combustor assembly of claim 16, wherein the first liner tile defines a third liner tile end face, the third liner tile end face comprising a geometric interlocking feature.

* * * * *